US011304473B2

(12) United States Patent
Whiteman et al.

(10) Patent No.: US 11,304,473 B2
(45) Date of Patent: Apr. 19, 2022

(54) ARTICLE OF FOOTWEAR INCORPORATING AN EMBROIDERED ELEMENT, AND RELATED METHODS OF MANUFACTURE

(71) Applicant: New Balance Athletics, Inc., Boston, MA (US)

(72) Inventors: John Robert Whiteman, Belmont, MA (US); Bryan Decker Gothie, Sudbury, MA (US); Timothy Kelvin Robinson, Arlington, MA (US); Michael Nelson White, Lawrence, MA (US)

(73) Assignee: New Balance Athletics, Inc., Boston, MA (US)

( * ) Notice: Subject to any disclaimer, the term of this patent is extended or adjusted under 35 U.S.C. 154(b) by 401 days.

(21) Appl. No.: 15/628,172

(22) Filed: Jun. 20, 2017

(65) Prior Publication Data

US 2018/0360156 A1 Dec. 20, 2018

(51) Int. Cl.

| | |
|---|---|
| ***A43B 1/04*** | (2006.01) |
| ***A43B 1/00*** | (2006.01) |
| ***A43B 3/00*** | (2006.01) |
| ***A43B 23/02*** | (2006.01) |

(52) U.S. Cl.

CPC ..... *A43B 1/04* (2013.01); *A43B 1/009* (2013.01); *A43B 1/0018* (2013.01); *A43B 3/0036* (2013.01); *A43B 23/025* (2013.01); *A43B 23/0245* (2013.01); *A43B 23/0265* (2013.01); *A43B 1/00* (2013.01); *A43B 3/00* (2013.01)

(58) Field of Classification Search

CPC ..... A43B 1/04; A43B 1/00; A43B 1/0018; A43B 1/009; A43B 1/02; A43B 3/0036; A43B 3/0078; A43B 3/00; A43B 23/0245; A43B 23/025; A43B 23/0265; A43B 23/02; A43B 23/0205; A43B 23/0255; A43B 23/02335; A43B 23/024

USPC ..... 36/83, 45

See application file for complete search history.

(56) References Cited

U.S. PATENT DOCUMENTS

| | | | | |
|---|---|---|---|---|
| 2008/0022554 | A1 | 1/2008 | Meschter et al. | |
| 2010/0018075 | A1* | 1/2010 | Meschter ..... | A43D 111/00 36/45 |
| 2010/0199520 | A1 | 8/2010 | Dua et al. | |

(Continued)

FOREIGN PATENT DOCUMENTS

DE 102015205751 A1 10/2016

OTHER PUBLICATIONS

International Search Report and Written Opinion for International Patent Application No. PCT/US2017/038263, dated Mar. 1, 2018 (17 pages).

*Primary Examiner* — F Griffin Hall
(74) *Attorney, Agent, or Firm* — Goodwin Procter LLP

(57) ABSTRACT

The invention relates to embroidered material portions for incorporation into an article of footwear, and systems and methods for the manufacture thereof. More particularly, the invention relates to an article of footwear having an upper with a sole structure, the upper including a first upper element including a base layer and a first structural layer including at least one first fiber embroidered onto the exterior surface of the base layer, the at least one first fiber forming a plurality of first elongate structural elements extending over the exterior surface of the base layer to provide discrete localized structural support to the base layer.

30 Claims, 17 Drawing Sheets

(56) References Cited

U.S. PATENT DOCUMENTS

| | | | | |
|---|---|---|---|---|
| 2011/0041359 | A1* | 2/2011 | Dojan | A43B 7/14 36/47 |
| 2013/0340283 | A1 | 12/2013 | Bell et al. | |
| 2016/0135543 | A1* | 5/2016 | Anceresi | A43B 23/024 36/45 |
| 2016/0286898 | A1* | 10/2016 | Manz | A43B 23/0245 |
| 2016/0316855 | A1* | 11/2016 | Berns | A43B 23/023 |

* cited by examiner

ARTICLE OF FOOTWEAR INCORPORATING AN EMBROIDERED ELEMENT, AND RELATED METHODS OF MANUFACTURE

FIELD OF THE INVENTION

The present invention relates generally to the field of footwear textiles and, more particularly, to portions of articles of footwear incorporating embroidered portions, and systems and methods for manufacture of such embroidered portions. The embroidered portions may be beneficial, for example, in creating selective regions of support and elasticity in a component of a shoe upper.

BACKGROUND OF THE INVENTION

The incorporation of textiles having different structural properties in different regions of the textile can be important in a number of industries and products. For example, footwear, and more particularly athletic footwear, often includes uppers with different stretch and support characteristics required in different regions of the upper. Traditionally, uppers for athletic footwear are formed from multiple different material portions, with those portions being placed in different regions of the upper of the footwear, and/or layered over each other in certain regions of the footwear, to provide the desired structural and performance characteristics for the shoe. Forming footwear from these multiple material portions can, however, be both labor intensive and expensive, while also potentially adding weight and other negative structural limitations to the structure and performance capabilities of the footwear.

SUMMARY OF THE INVENTION

Given the complexity, cost, and structural limitation associated with the formation of textile elements having complex and varied structural properties through traditional methods, it is desirable to provide improved methods and treatments for standard textiles that allow for the provision of complex structural and/or decorative features on the footwear through improved and, in certain embodiments, automated and/or customizable methods and systems. Accordingly, the systems and methods described herein provide innovative methods for creating unique structural and aesthetic features on and in fabric elements for use, for example, in the formation of uppers for articles of footwear.

A first aspect of the invention includes an article of footwear having an upper and a sole structure secured to the upper. The upper includes a first upper element including a base layer having an interior surface and an opposite exterior surface, the interior surface facing an interior of the article of footwear. The first upper element further includes a first structural layer including at least one first fiber embroidered onto the exterior surface of the base layer, the at least one first fiber forming a plurality of first elongate structural elements extending over the exterior surface of the base layer to provide discrete localized structural support to the base layer. The first elongate structural elements each include a longitudinal direction, a transverse width, a stitch density, and a stitch angle with respect to the longitudinal direction, and at least one of the longitudinal axis, the transverse width, the stitch density, and the stitch angle in at least one of the first elongate structural elements varies over a length of the first elongate structural element.

In one embodiment, the longitudinal direction and the transverse width of at least a portion of a first group of the first elongate structural elements vary over the length of those first elongate structural elements. In one embodiment, at least one of the longitudinal direction and the transverse width varies smoothly over a section of the length of the first group of first elongate structural elements. The longitudinal direction of a plurality of first elongate structural elements can differ from that of their adjacent first elongate structural elements. The first structural layer can reduce the stretch of a portion of the base layer in a direction substantially aligned with the longitudinal direction of the first elongate structural elements extending over that portion of the base layer. The amount of reduction in the stretch of the portion of the base layer may be positively related to the transverse width of the first elongate structural element extending over that portion of base layer.

At least a portion of the at least one first fiber embroidered onto the exterior surface of the base layer may be at least partially fused to the exterior surface of the base layer through the application of at least one of heat and pressure. Each elongate structural element may be formed from a different first fiber portion, or be formed from different regions of the same first fiber portion. The first fiber may include, or consist essentially of, at least one of a thread, a filament, a cord, a lace, a strand, a ribbon, and a band. The first fiber may, for example, include, or consist essentially of, thermoplastic polyurethane, polyester, nylon, and/or a natural fiber. The first fiber may be machine embroidered to the base layer or hand embroidered. In one embodiment the first fiber is securely embroidered to the base layer by at least one bobbin thread extending on the interior surface of the base layer adjacent to the first fiber, and the bobbin thread may include, or consist essentially of, a material selected from the group consisting of thermoplastic polyurethane, polyester, nylon, and a natural fiber. The bobbin thread may be at least partially fused to the interior surface of the base layer through the application of at least one of heat and pressure.

In one embodiment, at least a portion of the plurality of first elongate structural elements extend in a direction substantially parallel to at least one predominant direction of strain which the finished article of footwear will be subject to during a first athletic movement. The stitch density may be between 10 and 30 stitches per centimeter, or between 15 and 25 stitches per centimeter, or approximately 20 stitches per centimeter. The stitch angle may be between 30 and 60 degrees from the longitudinal direction and, for example, be approximately 45 degrees from the longitudinal direction.

The article of footwear can further include a second structural layer including at least one second fiber embroidered onto the exterior surface of the base layer, the at least one second fiber forming a plurality of second elongate structural elements extending over the exterior surface of the base layer to provide localized structural support to the base layer. The second elongate structural elements can each comprise a longitudinal direction, a transverse width, a stitch density, and a stitch angle with respect to the longitudinal direction, and at least one of the longitudinal axis, the transverse width, the stitch density, and the stitch angle in at least one of the second elongate structural elements can vary over a length of the second elongate structural element. An arrangement of the second elongate structural elements can differ from an arrangement of the first elongate structural elements.

The longitudinal direction and the transverse width of at least a portion of a first group of the second elongate structural elements can vary over the length of those second elongate structural elements. At least one of the longitudinal direction and the transverse width can vary smoothly over a section of the length of the first group of second elongate structural elements. The longitudinal direction of a plurality of second elongate structural elements can differ from that of their adjacent second elongate structural elements. The second structural layer can reduce the stretch of a portion of the base layer in a direction substantially aligned with the longitudinal direction of the second elongate structural elements extending over that portion of the base layer. The amount of reduction in the stretch of the portion of the base layer can be positively related to the transverse width of the second elongate structural element extending over that portion of base layer.

In one embodiment, at least a portion of the at least one second fiber embroidered onto the exterior surface of the base layer is at least partially fused to the exterior surface of the base layer through the application of at least one of heat and pressure. Each elongate structural element can be a different second fiber portion or be formed from different regions of a single fiber. The second fiber can include, or consist essentially of, at least one of a thread, a filament, a cord, a lace, a strand, a ribbon, and a band. The second fiber can be the same material or a different material to the first fiber. At least a portion of the plurality of second elongate structural elements can extend in a direction substantially parallel to at least one secondary direction of strain which the finished article of footwear will be subject to during a second athletic movement. At least one of a color, a material, and a diameter of the first fiber can differ from that of the second fiber. The second structural layer can include a first region extending over the exterior surface of the base layer and at least a portion of the first structural layer. The second structural layer can further include a second region extending over a portion of the exterior surface of the base layer on which the first structural layer is absent. The first structural layer can also include a region extending over a portion of the exterior surface of the base layer on which the second structural layer is absent.

The article of footwear can, in one embodiment, include an interior liner having an interior surface and an opposite exterior surface, wherein the exterior surface of the interior liner is positioned adjacent the interior surface of the base layer, and wherein the interior surface of the interior liner encloses a void into which a foot of a wearer of the article of footwear can be positioned. The article of footwear can include a third structural layer having at least one third fiber embroidered onto the exterior surface of the base layer over the first structural layer, the at least one third fiber forming at least one of a boundary of at least one lace hole and an identifying indicia.

Another aspect of the invention includes a method of forming at least a portion of an upper for an article of footwear. The method includes providing a base layer having an interior surface and an opposite exterior surface and identifying at least one first direction of strain that the base layer will be subject to during a first athletic movement upon incorporation into an article of footwear. The method further includes embroidering a first structural layer including at least one first fiber onto the exterior surface of the base layer, the at least one first fiber forming a plurality of first elongate structural elements extending over the exterior surface of the base layer and extending in a direction substantially parallel to the at least one first direction of strain to provide localized structural support to the base layer. The first elongate structural elements can each include a longitudinal direction, a transverse width, a stitch density, and a stitch angle with respect to the longitudinal direction, and at least one of the longitudinal axis, the transverse width, the stitch density, and the stitch angle in at least one of the first elongate structural elements can vary over a length of the first elongate structural element. The method further includes incorporating the base layer and embroidered first structural layer into an upper of the article of footwear.

In one embodiment, the method also includes identifying at least one second direction of strain that the base layer will be subject to during a second athletic movement upon incorporation into the article of footwear and embroidering a second structural layer including at least one second fiber onto the exterior surface of the base layer, the at least one second fiber forming a plurality of second elongate structural elements extending over the exterior surface of the base layer in a direction substantially parallel to the at least one second direction of strain to provide localized structural support to the base layer. The second elongate structural elements can each include a longitudinal direction, a transverse width, a stitch density, and a stitch angle with respect to the longitudinal direction, and at least one of the longitudinal axis, the transverse width, the stitch density, and the stitch angle in at least one of the second elongate structural elements can vary over a length of the second elongate structural element. In addition, an arrangement of the second elongate structural elements can differ from an arrangement of the first elongate structural elements.

In one embodiment, identifying the first direction of strain includes an analysis of experimental strain data at a plurality of locations on an article of footwear (and, for example, on the external surface of an article of footwear) during a first athletic movement. The transverse width of the first and second elongate structural elements at a given location on the base layer can relate substantially to the magnitude of the strain at that location.

Another aspect of the invention relates to an article of footwear having an upper and a sole structure secured to the upper. The upper includes a first upper element including a base layer having an interior surface and an opposite exterior surface, the interior surface facing an interior of the article of footwear. The first upper element further includes a first structural layer including a plurality of first embroidered elongate elements extending over at least a portion of the exterior surface of the base layer, wherein the first embroidered elongate elements each include a longitudinal direction, a transverse width, a stitch density, and a stitch angle with respect to the longitudinal direction. At least one of the longitudinal axis and the transverse width in at least one of the first embroidered elongate elements varies over a length of the first embroidered elongate element. At least a portion of at least one first embroidered elongate element is at least partially fused to the exterior surface of the base layer through the application of at least one of heat and pressure. At least a portion of the plurality of first embroidered elongate elements extends in a direction substantially parallel to at least one predominant direction of strain which the finished article of footwear will be subject to during a first athletic movement.

The first upper element further includes a second structural layer including a plurality of second embroidered elongate elements extending over at least a portion of the exterior surface of the base layer, wherein the second embroidered elongate elements each include a longitudinal direction, a transverse width, a stitch density, and a stitch angle with respect to the longitudinal direction. At least one of the longitudinal axis and the transverse width in at least one of the second embroidered elongate elements varies over a length of the second embroidered elongate element. At least a portion of at least one second embroidered elongate element is at least partially fused to the exterior surface of the base layer through the application of at least one of heat and pressure. At least a portion of the plurality of second embroidered elongate elements extend in a direction substantially parallel to at least one secondary direction of strain which the finished article of footwear will be subject to during a second athletic movement. In addition, an arrangement of the second embroidered elongate elements differs from an arrangement of the first embroidered elongate elements.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described.

Figure 1A:
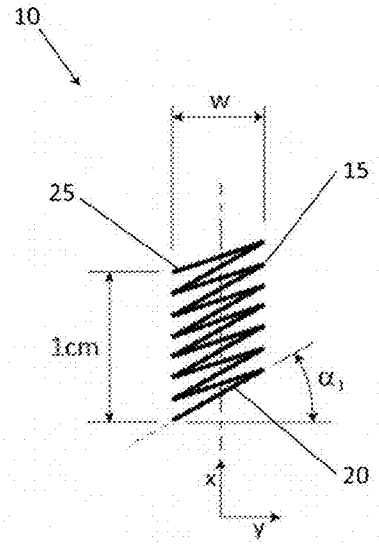
FIGS. 1A to 1C are schematic views of exemplary elongate embroidered elements, in accordance with some embodiments of the invention.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

DETAILED DESCRIPTION

The invention described herein relates in general to methods and systems for producing fabrics having improved performance and/or aesthetic characteristics, and to products incorporating such fabrics. More particularly, the invention described herein relates to fabric material portions having embroidered structural elements to provide structural and/or aesthetic benefits to the fabric for use, for example, in athletic footwear.

The invention allows for the treatment of fabrics/textiles (e.g., standard knit, woven, or non-woven textiles, meshes, sheets, laminates, etc.) through the application of an embroidered thread without the need to incorporate multiple additional materials into the textiles during the formation of those textiles, and without the need to stitch or bond other materials to the textile to produce the desired structural and/or aesthetic properties. Rather, the methods described herein provide a method by which standard untreated, off-the-shelf, fabrics can be customized to produce finished material elements having a variety of complex structural properties, thereby reducing material costs and simplifying the manufacturing process. The engineered materials created hereby can be utilized in any number of products and industries, including, but not limited to, footwear (and, for example, athletic footwear), apparel, sporting goods (e.g., lacrosse stick nets, protective sports gear, etc.) and other goods requiring complex textile constructions. In addition to uses within the athletics and fashion industries such structures may, for example, be useful in the automotive, aerospace, and consumer goods industries.

More particularly, the methods and systems described herein provide one or more embroidery patterns that can be applied to a fabric/textile and which can selectively and discretely change one or more property of the textile in the embroidered area(s) without substantially changing the properties of the textile in the non-embroidered region(s). As a result, a single textile can be modified to provide a variety of complex structural properties with the minimum of added embroidered threads (thereby limiting the additional weight of the material and reducing the manufacturing steps and labor necessary to create the complex structural features required). In operation, the addition of elongate embroidered elements (i.e., embroidered elements having a length substantially longer than its width) onto one or more base materials of a shoe upper can provide structural stability, reduced stretch, increased stiffness, increased strength, and other structural benefits to the base material at the regions in which the embroidery is added and in the longitudinal directions in which the embroidered elongate elements traverse the base material, with limited additional weight and without substantively affecting the structural properties of the base material away from the embroidered elements or in directions substantially different from the longitudinal directions of the embroidered elements. This provides a mechanism for adding controlled structural benefits to the base material without the need to add additional materials or structural elements onto the base material.

The embroidering process can be carried out by hand or, preferably, be carried out using a mechanical embroidery machine. Using mechanized embroidery processes allows for the efficient and accurate embroidering of structural elements in an automated manner. The embroidering can be carried out using standard embroidering processes, as appropriate. In one embodiment, the embroidering is performed using a machine embroidery process utilizing a bobbin thread extending on the interior surface of the base layer adjacent to the first fiber to hold the embroidered thread securely in place. The bobbin thread can include, or consist essentially of, a material such as thermoplastic polyurethane, polyester, nylon, and/or a natural fiber. In one embodiment, the bobbin thread can be at least partially fused to the interior surface of the base layer through the application of at least one of heat and pressure (either indirectly through the outer surface or directly to the inner surface). This may be beneficial, for example, in providing a smoother surface on the inner side of the base layer and providing a more secure and stable stitch for the embroidery.

In various embodiments, the material for the base layer can include, or consist essentially of, a textile or other fabric such as a knit material, a woven material, a non-woven material, a skrim, or any other appropriate fabric material. Alternatively, the base layer can be formed from a film or sheet or a polymeric substrate (e.g., a TPU film) or any other material capable of providing structural stability to the embroidered threads. In certain embodiments the base material can be formed from multiple layers of material. The base layer, or layers, can be made of materials such as, but not limited to, a polyester, a nylon, a spandex or other elastic material, a natural fiber (e.g., cotton or wool), a natural or synthetic leather, a blend thereof, a thermoplastic polyurethane (TPU) or any other appropriate material for use in the construction of footwear uppers. In certain embodiments a layer of material can be positioned over the embroidered layer, or a portion thereof, in addition to, or in place of, a base layer under the embroidered portion. The covering layer, or layers, can be formed of a transparent or an opaque material (which may be the same as, or different than, the base layer material), depending on whether it is desired for the embroidered fibers to be visible below the covering layer.

In one embodiment the upper can further include one or more interior liner layers positioned between the interior surface of the base layer and a foot of a wearer of the shoe. This interior liner can be fully attached to (e.g., bonded, stitched, etc.), locally attached to at distinct positions, or unattached to the base layer. In addition, one or more covering layers can be similarly positioned over the base layer(s) and embroidered layers on an outer surface of the upper.

In one embodiment, embroidered portions can be incorporated into cleated footwear, such as a soccer or football boot. In alternative embodiments, other types of athletic footwear, such as track spikes, trail shoes, running shoes, training shoes, tennis shoes, golf shoes, etc., can incorporate one or more embroidered portions. In further alternative embodiments, other types of footwear, such as safety footwear, fashion footwear, etc., can be formed at least in part from the embroidered structures.

The threads may be embroidered onto the base layer while it is held flat, or substantially flat, after which the embroidered material can be incorporated into an article of footwear, or other structure. For example, one or more threads can be embroidered onto a sheet of material held firmly within an embroidery machine during the embroidery process. After embroidering the required pattern onto the sheet, a footwear shell pattern, or a portion thereof, can be cut from the sheet for incorporation into the article of footwear. Alternatively, the material base layer can be removably placed onto a footwear last, or other three-dimensional mounting element, with the thread thereafter embroidered directly onto the shaped material on the mounting element.

Figure 1B:
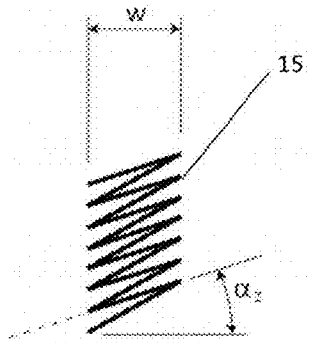
Figure 1C:
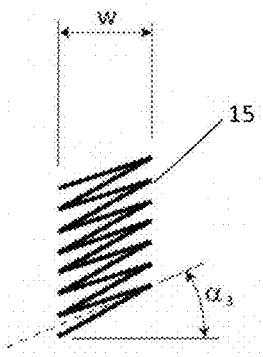

FIGS. 1A through 1C shows an elongate embroidered element 10 formed from a thread 15 extending along an elongate axis "x". The thread 15 is embroidered onto a base material (not shown) in a zig-zig stitch, with a first plurality of stitches 20 extending across the transverse width "w" of the elongate embroidered element 10 at a first angle ($\alpha_1$) to the transverse axis "y", and a second plurality of stitches 25 extending back across the width "w" of the elongate embroidered element 10 at a second angle ($\alpha_2$) to the transverse axis "y". The average angle ($\alpha_3$) of each zig-zag stitch which, in certain embodiments, can be used to define the angle of the embroidery stitching with respect to the transverse axis "y" at a given position along the elongate axis of the elongate embroidered element 10, is therefore $(\alpha_1+\alpha_2)/2$. In alternative embodiments, the angle ($\alpha_1$) of the first stitches 20, or the angle ($\alpha_2$) of the second stitches 25, can be used to define the general angle of the embroidery stitching with respect to the elongate axis "x" or transverse axis "y" at a given position along the elongate axis of the elongate embroidered element 10. The angle can be calculated with respect to the transverse axis "y" or elongate axis "x", as appropriate.

The elongate embroidered element 10 is formed from a plurality of first stitches 20 and second stitches 25 which span across the width "w" in a zig-zag pattern, with the width "w" determined in a direction perpendicular to the longitudinal elongate axis "x" of the elongate embroidered element 10 at a given location. The structural properties of the resulting elongate embroidered element 10 can be controlled through the selection of a number of parameters associated with the embroidery stitching, including the angle(s) ($\alpha_1$, $\alpha_2$, $\alpha_3$) of the embroidery stitching with respect to the elongate axis "x", the width "w" of the stitching, the density of the stitches (which is controlled by the difference between the first angle ($\alpha_1$) and second angle ($\alpha_2$), and which can, for example, be defined by the number of stitches per centimeter), and the structural and performance properties of the thread 15, or threads, used to form the elongate embroidered element 10.

Figure 2A:
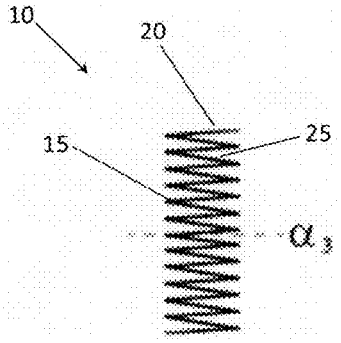
FIG. 2A is a schematic view of another exemplary elongate embroidered element, in accordance with some embodiments of the invention.
Figure 3A:
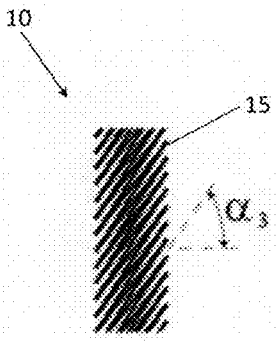
FIG. 3A is a schematic view of another exemplary elongate embroidered element, in accordance with some embodiments of the invention.

For example, changes in the stitch angle(s) ($\alpha_1$, $\alpha_2$, $\alpha_3$) of the embroidery stitching with respect to the elongate axis "x" and transverse axis "y" can change both the aesthetic and/or structural properties of the elongate embroidered element 10, with an increase in the average angle of the embroidery stitching changing the density of thread material in the resulting elongate embroidered element 10. For example, FIG. 2A shows a portion of an elongate embroidered element 10 having a stitch angle $\alpha_3$ of 0°, while FIG. 3A shows a portion of an elongate embroidered element 10 having a stitch angle $\alpha_3$ of 55° (while the distance between each first stitch 20 and second stitch 25 remains the same). In alternative embodiments, any appropriate embroidery angle may be utilized, such as an angle ($\alpha_1$, $\alpha_2$, or $\alpha_3$) of between 0° to up to 75° or more, or between about 20° to about 70°, or between about 30° to about 60°, or between about 40° to about 50°, or, for example 45°. Any other appropriate angle, or range of angles, may be utilized depending upon the specific structural and aesthetic properties required.

The stitch configuration of FIG. 3A results in a longer stitch length across the width "w" of the elongate embroidered element 10, when compared to FIG. 2A, which results in a more densely stitched elongate embroidered element 10 with more thread material incorporated into a given area of the embroidered element. This will, in turn, increase the structural effect of the elongate embroidered element 10 on the underlying base material while also providing a different aesthetic look to the elongate embroidered element 10.

Figure 4A:
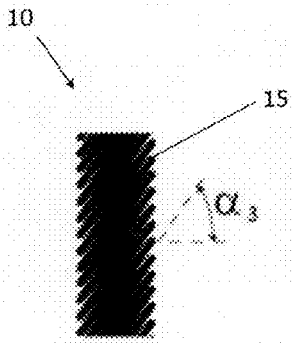
FIG. 4A is a schematic view of another exemplary elongate embroidered element, in accordance with some embodiments of the invention.

In one embodiment, changing the dimensions of the thread 15 can change the structural and/or aesthetic properties of the resulting elongate embroidered element 10, with a larger thread diameter resulting in an increase in the density of thread material in the resulting elongate embroidered element 10. FIG. 4A, for example, shows a similar embroidery pattern to FIG. 3A, but with a thread 15 having a diameter of twice that of the thread 15 of FIG. 3A, thereby resulting in an elongate embroidered element 10 having a more closed or continuous material look and structure.

The thread 15, or threads, used to form the elongate embroidered element 10 can be a monofilament-type thread, a multi-filament thread, a wound multi-component thread (with, for example, a fusable strand wound with a non-fusable strand), and/or a coated thread. Exemplary materials that can be used for the thread include, but are not limited to natural fibers, synthetic fibers, and/or thermoplastics (e.g., TPU, polyester, nylon, etc.). In one embodiment, the thread is a TPU mono-filament or a multi-filament thread. In another embodiment the thread is formed as a mono-filament or multi-filament core coated, sheathed, or otherwise surrounded by a thermoplastic (e.g., TPU) coating.

In one embodiment, upon embroidery stitching the thread to the base material, the thread may be heat treated to fuse, or partially fuse, the thread(s) to the base material. The extent to which the thread is fused to the base material can be controlled through selection of the temperature, time of exposure, and pressure applied to the thread during fusing. The fusing of the thread to the base material can be applied through a plate or other element which applies heat and pressure to the entire base layer, or a portion thereof. Alternatively, the thread can be fused to the base layer through the use of a localized heat/pressure application mechanism which can, for example, be associated with the embroidery machine such that the fusing element follows behind the stitch head to fuse the thread to the base material immediately, or substantially immediately, after stitching. If the thread comprises, or consists essentially of, a thermoplastic mono-filament or multi-filament thread, the thread material will melt and bond to the base material to form the finished elongate embroidered element. In one embodiment, if the thread comprises, or consists essentially of, an inner core surrounded by a thermoplastic coating, the thread can be heat fused in such a way as to leave the inner core substantially unchanged as an elongate thread embroidered to the base material, with the outer coating melting and setting to form a protective covering over the embroidered core that holds the thread in place on the surface of the base material. In one embodiment, the base material(s) may include a material or treatment adapted to bond or otherwise adhere the embroidered thread to the base material upon application. In one embodiment, an outer skin can be laid over (and, for example bonded or otherwise laminated over) the embroidery and base material(s) to provide a protective cover for the embroidery.

In application, heat melting the thread 15 can be beneficial, for example, in further securing the thread to the base material, providing a protective covering over the thread to reduce damage to the embroidery through abrasion, bonding adjacent threads together to produce a more uniform structure for the elongate embroidered element 10, and/or modifying the aesthetic of the embroidered thread. In one embodiment, the entire embroidered thread can be fused, or partially fused, to the base material. In an alternative embodiment, only selective portions of the thread are fused, or partially fused, to the base layer.

Figure 2B:
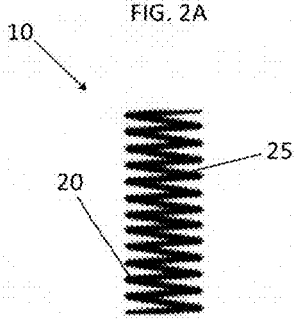
FIG. 2B is a schematic view of the elongate embroidered element of FIG. 2A after fusing the embroidery thread to the base material.

Along with selection of the thread diameter and stitch angle, controlling the fuse melting of the thread can create a broad range of structural characteristics and aesthetic looks, ranging from open, clearly stitched, through partially fused embroidered patterns, to fully closed/continuous blocks of material. For example, FIG. 2B shows the elongate embroidered element 10 of FIG. 2A after the application of heat and pressure to fuse the thread 15 to a base material. In this embodiment, the embroidery pattern created by the first stitches 20 and second stitches 25 of the fused thread 15 is still clearly visible.

Figure 3B:
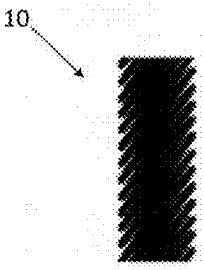
FIG. 3B is a schematic view of the elongate embroidered element of FIG. 3A after fusing the embroidery thread to the base material.

FIG. 3B shows the elongate embroidered element 10 of FIG. 3A after the application of heat and pressure to fuse the thread 15 to a base material. In this embodiment, the effect of the increased stitch angle (where $\alpha_3$=55°) is to effectively bring the first stitches 20 and second stitches 25 closer together so that, upon bonding, the first stitches 20 and second stitches 25 partially blend together.

Figure 4B:
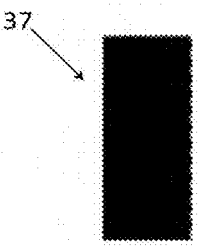
FIG. 4B is a schematic view of the elongate embroidered element of FIG. 4A after fusing the embroidery thread to the base material.

FIG. 4B shows the elongate embroidered element 37 of FIG. 4A after the application of heat and pressure to fuse the thread 30 to a base material. In this embodiment, the effect of the stitch angle ($\alpha_3$) and the thread thickness is to effectively bring the first stitches 20 and second stitches 25 close enough together so that, upon bonding, the first stitches 20 and second stitches 25 substantially completely blend together to form an elongate element 37 that is substantially uniform in appearance. In embodiments where the thread is formed entirely from a meltable and fusable material the structure of this elongate element 37 can be homogeneous, or substantially homogeneous, in form. In embodiments where the thread is formed from an outer coating of a meltable and fusable material surrounding a core (having a melting point such that it doesn't melt at the temperature necessary to melt the outer coating) the resulting elongate element 37 will have the outer appearance of a homogeneous, or substantially homogeneous, structure, but with the core of the thread 15 oriented according to the embroidery pattern within the homogeneous outer layer.

In an alternative embodiment, the embroidered material can be replaced with an ink or other treatment to provide a purely aesthetic treatment to the material. In another embodiment, the embroidered material can be replaced with a laid fiber, a film, a foam (puff) print, a laminate or other structural material to provide both a structural and aesthetic treatment to the material.

Figures 5A, 5B:
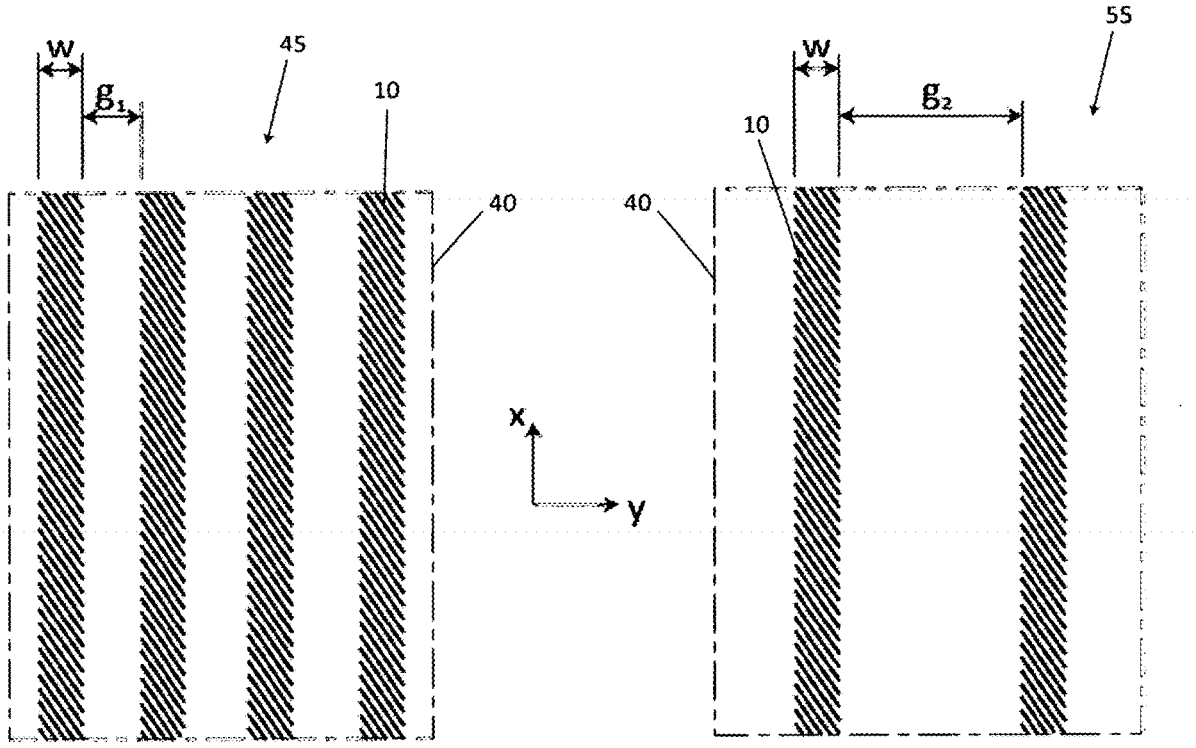
FIG. 5A is a schematic view of a material incorporating a plurality of elongate embroidered elements, in accordance with some embodiments of the invention.
FIG. 5B is a schematic view of another material incorporating a plurality of elongate embroidered elements, in accordance with some embodiments of the invention.

The structural properties of an embroidered material in accordance with the invention can be controlled by both the properties of the individual elongate embroidered elements themselves and the arrangement and density of a group of elongate embroidered elements with respect to each other on the base material. For example, decreasing the distance or gap ("g") between adjacent elongate embroidered elements 10, and therefore increasing the density of elongate embroidered elements 10 within a set area of the embroidered material, will increase the effect of a group of elongate embroidered elements 10 on the properties of the embroidered material. As an example, the base material 40 of FIG. 5A incorporates a plurality of discrete, separate, elongate embroidered elements 10 having a width "w" and a gap "$g_1$", thereby producing an embroidered material 45 having four separate, spaced elongate embroidered elements 10 in a given area (each of the spaced elongate embroidered elements 10 having a zig-zag type stitch pattern having a defined stitch angle and stitch length, thereby creating an embroidered element having a distinct width), while the base material 40 of FIG. 5B incorporates a plurality of elongate embroidered elements 10 having a width "w" and a gap "$g_2$" (where $g_2$ is greater than $g_1$), thereby producing an embroidered material 55 having only two elongate embroidered elements 10 in the same area. As a result, with the properties of each discrete, individual elongate embroidered element 10 being the same, the embroidered material 45 of FIG. 5A will be more resistant to stretch, and potentially more resistant to bending, along the x-axis than the embroidered material 55 of FIG. 5B. However, both the embroidered material 45 of FIG. 5A and the embroidered material 55 of FIG. 5B will retain a reasonable degree of stretch and flexibility along the y-axis (i.e., at angles substantially perpendicular to the elongate direction of the elongate embroidered elements 10) due to the fact that there isn't a continuous element restricting elongation along that axis, but rather a plurality of discrete elements with unmodified elastic base material in between. Any reduction in the degree of stretch along the y-axis will be dependent on at least one of the density, width "w", stitch angle and material properties of each of the elongate embroidered elements 10. In one embodiment, the resistance to stretch of the embroidered material at angles between the x-axis and y-axis will vary smoothly from a maximum resistance to stretch (along the x-axis) to a minimum resistance to stretch (along the y-axis), with the specific resistance to stretch at any given angle dependent on at least one of the density, width "w", stitch angle and material properties of the elongate embroidered elements 10, along with the stretch properties of the base material itself. In various embodiments, the elongate structural elements can be adapted to reduce stretch to different degrees in a variety of directions with respect to the elongate axis depending upon factors such as the width, stitch angle, thread properties, and/or stitch density.

In one embodiment, the base material may be manufactured such that, prior to embroidering, it has the same, or substantially the same, resistance to stretch in all directions. As such, the variation in resistance to stretch of the embroidered material is dependent entirely, or substantially entirely, on the properties of the elongate embroidered elements 10. In an alternative embodiment, the base material, or portions thereof, can be manufactured, such that it has a different resistance to stretch at different angles, with the embroidering of the elongate embroidered elements 10 onto the base material modifying those variations in resistance to stretch as required.

Figure 6A:
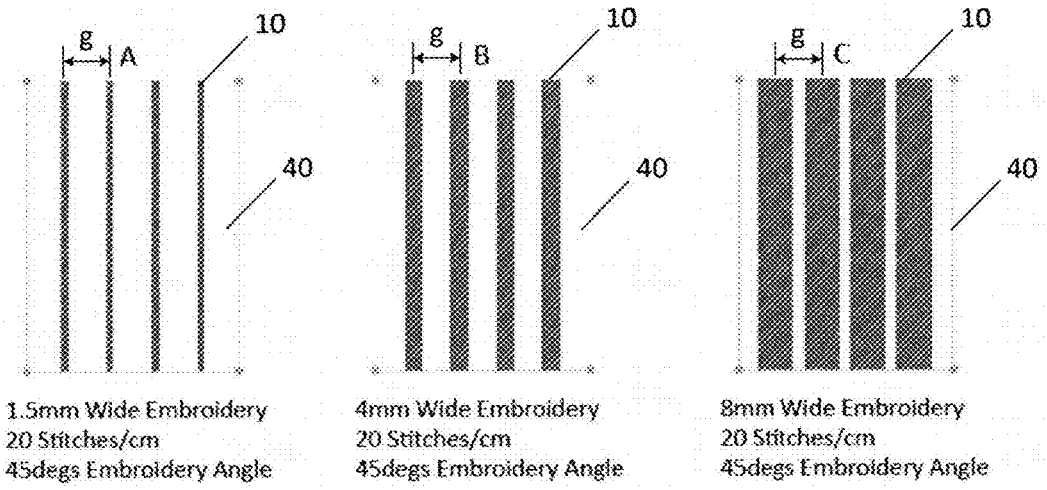
FIG. 6A is a schematic view of a number of test swatches of materials incorporating a plurality of elongate embroidered elements, in accordance with some embodiments of the invention.
Figure 6B:
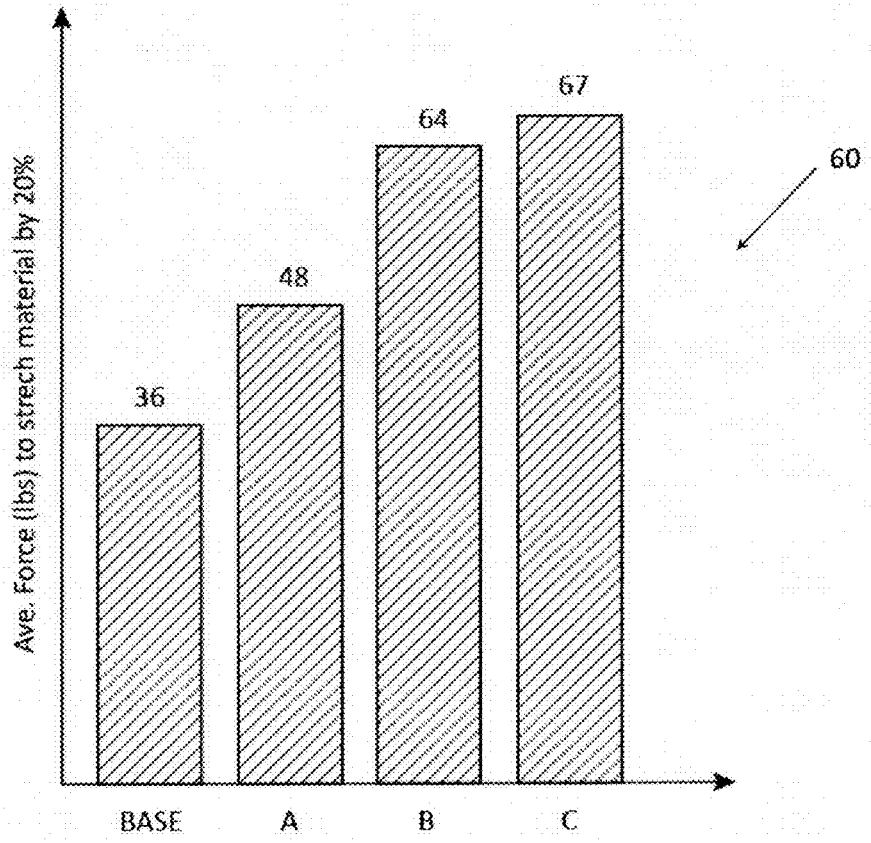
FIG. 6B is a chart showing the resistance to stretch of the test swatches of FIG. 6A under laboratory conditions.

An example of the effect of positioning elongate embroidered elements 10 on a base material can be seen in FIGS. 6A and 6B. FIG. 6A shows three variations of a test sample of embroidered material ("A", "B", and "C"), with each test sample being formed from a base material 40 (in this case a synthetic leather material) onto which four elongate embroidered elements 10 of TPU thread have been embroidered at a distance "g" apart. Each of the elongate embroidered elements 10 has a stitch density of 20 stitches per centimeter and a stitch angle ($\alpha_1$) of 45 degrees to the transverse axis. The elongate embroidered elements 10 of sample "A" have a width "w" of 1.5 mm, the elongate embroidered elements 10 of sample "B" have a width "w" of 4 mm, and the elongate embroidered elements 10 of sample "C" have a width "w" of 8 mm.

FIG. 6B shows a graph 60 the average force (in pounds) needed to stretch the test samples by 20% over their unstretched length for each of the test samples ("A", "B", and "C") and additionally for a sample of unembroidered base material. As can be seen, adding elongate embroidered elements 10 of any width to the base material significantly increases the resistance to stretch of the embroidered material compared to an equivalent sample of un-embroidered material. In addition, with all other factors remaining constant, the resistance to stretch of an embroidered material is directly related to the width "w" of the elongate embroidered elements 10, with increases in the width "w" correlating to an increase in resistance to stretch. In the embodiment shown, the relationship between elongate embroidered element width and embroidered material resistance to stretch is somewhat/approximately logarithmic in form, with the resistance to stretch for a base material covered by a single layer of embroidered elements reaching a maximum where the width "w" of each embroidered element is equal to the gap "g" between elements (thereby resulting in the entire embroidered material being covered in embroidery). In certain embodiments, the resistance to stretch of the embroidered material can be further increased by adding additional layers of embroidery and/or by increasing the width "w", and/or decreasing the gap "g", in order to have the adjacent embroidered elements overlap.

In one embodiment, as shown in FIG. 6A, the embroidered material can be formed from one or more base layers onto which a plurality of elongate embroidered elements 10 are embroidered as straight parallel elements in a regularly distributed arrangement, thereby creating an embroidered material having consistent, or substantially consistent, properties in a set direction across the entire area of the embroidered material. In an alternative embodiment, the stretch properties of different portions of the embroidered material can be controlled and differentiated by varying the properties of single discrete elongate embroidered elements 10 along their length and/or by varying the relationship between adjacent elongate embroidered elements 10 in different regions of the embroidered material.

Figure 7A:
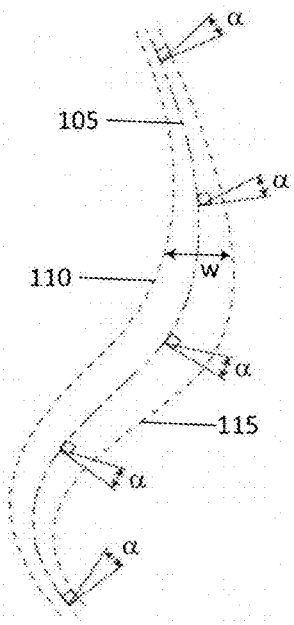
FIG. 7A is a schematic view of a path and outline of an exemplary elongate embroidered element, in accordance with some embodiments of the invention.
Figure 7B:
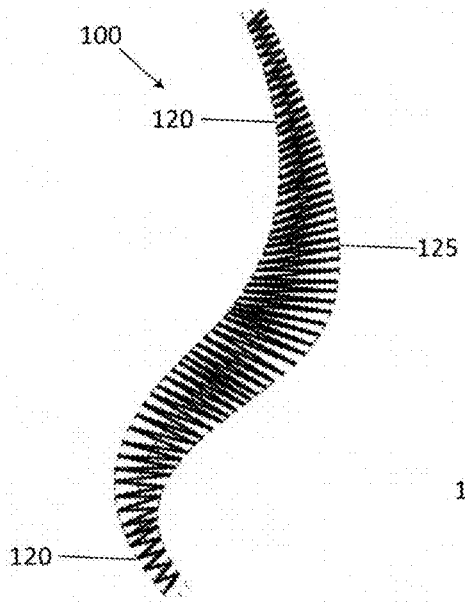
FIG. 7B and FIG. 7C are exemplary elongate embroidered elements following the path and outline of FIG. 7A.

In one embodiment, as shown in FIGS. 7A to 7B, an elongate embroidered element 100 can be formed with an elongate axis that changes direction along its length, thereby changing the primary direction of resistance to stretch along the length of the element. FIG. 7A shows a dimensional schematic representation of an elongate embroidered element 100 having a primary elongate axis 105, a first side edge 110, and a second side edge 115. The stitch angle (a) of the embroidery is calculated locally as the angle between the direction of the embroidery stitch 120 and the direction of the transverse axis at each location along the elongate axis 105. In the embodiment of FIG. 7A and FIG. 7B the direction of the primary elongate axis 105 changes smoothly along the length of the elongate embroidered element 100. This may be advantageous, for example, in preventing points of high stress and/or strain within the material (which could result from abrupt changes in stretch over a small distance) and can allow the embroidery process to be carried out more rapidly during manufacturing (without the time delays associated with rapidly reorienting the embroidery machine to account for abrupt changes in direction). In alternative embodiments, where abrupt changes in direction could be beneficial for structural and/or aesthetic reasons, one or more abrupt/sharp changes in direction at a point (or a very small distance) can be incorporated into the elongate embroidered element 100 in addition to, or instead of, smooth changes in direction of the primary elongate axis 105.

As a result of the variations in direction of the elongate embroidered element 100 along its length, the primary direction of resistance to stretch at a specific portion of an embroidered material can be controlled to provide targeted and customized structural properties at different portions of an object (e.g., a shoe upper) into which the embroidered material is incorporated. In addition, the amount of resistance to stretch can be varied along the length of the elongate embroidered element 100 by changing the width "w" of the embroidery at different locations along the elongate axis. For example, as shown in FIG. 7B, the elongate embroidered element 100 can have an embroidery pattern that has relatively narrow portions 120 providing a first degree of stretch and relatively wide portions 125 providing a second degree of stretch, wherein the second degree of stretch is less than the first degree of stretch, with the width, and therefore the degree of stretch, varying smoothly from the relatively narrow portions 120 to the relatively wide portions 125. In one embodiment, the relatively narrow portions 120 can have a width "w" of less than about 4 mm, or even less than about 2 mm, while the relatively wide portions 125 can have a width of more than about 4 mm. In certain embodiments relatively narrow portions 120 can have a width "w" of less than about 75%, or less than about 50%, or even less than about 30% of the width "w" of the relatively wide portions 125.

Figure 7C:
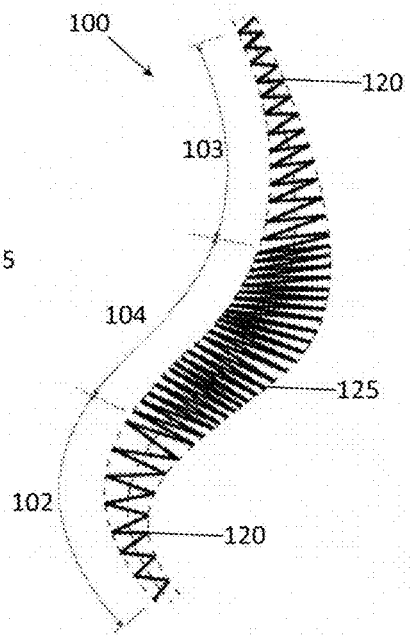

In addition to changes in the direction of the primary elongate axis 105 and the width "w" of the elongate embroidered element 100, other physical properties of the elongate embroidered element 100 can be varied along the length of the elongate embroidered element 100 to locally change the structural and aesthetic properties of the material. For example, FIG. 7C shows an elongate embroidered element 100 having first and third regions (102 and 103) having a first stitch density (and including relatively narrow portions 120) and a second region 104 having a second stitch density greater than the first stitch density and including relatively wide portion 125). The effect of the reduced stitch density in first region 102 and third region 103 is to further reduce those regions resistance to stretch to a greater extent than that provided by the reduced width "w", thereby increasing the difference in stretch resistance between first region 102 and third region 103 on one hand, and second region 104 on the other hand.

Figure 8A:
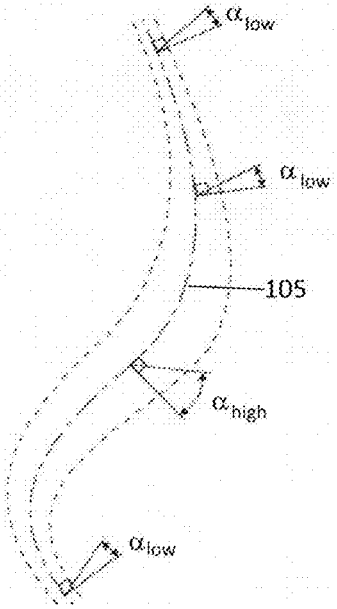
FIG. 8A is a schematic view of a path and outline of another exemplary elongate embroidered element, in accordance with some embodiments of the invention.
Figure 8B:
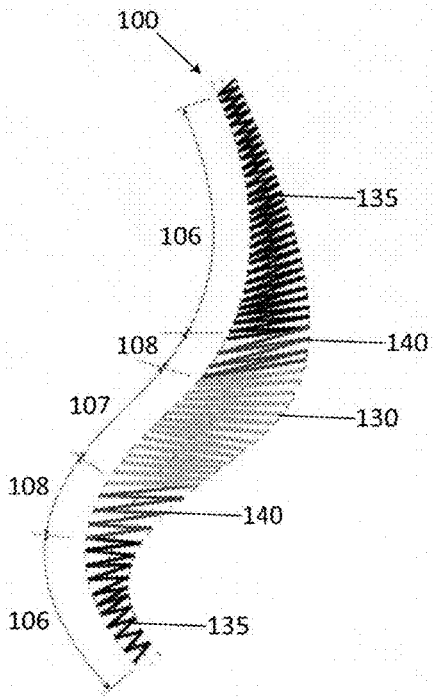
FIG. 8B is an exemplary elongate embroidered element following the path and outline of FIG. 8A.

In the embodiment of FIGS. 8A and 8B, the elongate embroidered element 100 is configured to have the stitch angle change from region to region. In this embodiment, the elongate embroidered element 100 includes relatively narrow portions 106 having a first, lower, stitch angle "$\alpha_{low}$," and a relatively wide portion 107 having a second, larger, stitch angle "$\alpha_{high}$", with the stitch angle transitioning smoothly between "$\alpha_{low}$," and "$\alpha_{high}$" in transition regions 108. The effect of this variation in stitch angle is to further vary the resistance to stretch from region to region to a greater extent than that provided by variations in width "w" alone with, in one embodiment, an increase in stitch angle toward the direction of the primary elongate axis 105, thereby aligning the thread with the primary elongate axis 105 to a greater extent, increasing the resistance to stretch along the primary elongate axis 105 in regions of higher stitch angle.

Figure 9:
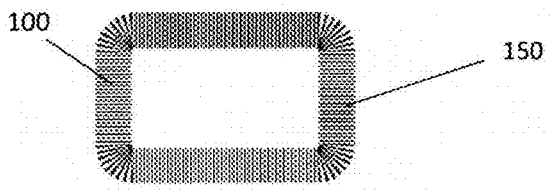
FIG. 9 is a schematic view of an embroidered eyelet for a lacing element, in accordance with some embodiments of the invention.

Through careful selection of the direction, width, stitch density, and/or stitch angle of the elongate embroidered element 100, and variations to one or more of these structural features along the length of the elongate embroidered element 100, the localized strength, stretch resistance, abrasion characteristics (i.e., with more embroidered material in a region contributing to greater abrasion resistance for the material in that region), and aesthetic properties of the embroidered material can be carefully controlled and adapted to provide materials having unique structural properties. These structural features can be smoothly modified from region to region or can abruptly change from one location to the next, depending upon the specific structural requirements of each region of the material. The ability to modify and control performance characteristics of the material through careful selection of embroidery patterns on a base material also allows for the manufacture of unique engineered materials efficiently and quickly in a single embroidering process without the need for additional complex, costly, and time consuming manufacturing steps. The embroidery can be applied over large portions of the base material to affect the structural properties of large regions of the finished material and/or be applied locally to limited regions of the base material to provide specific localized structural benefits. FIG. 9, for example, shows an embroidered element 150 formed as a closed loop to form an eyelet through which a lacing element can be located, with the elongate embroidered element 100 providing strength to the eyelet to prevent the lacing element tearing the material when tightened.

Figure 10:
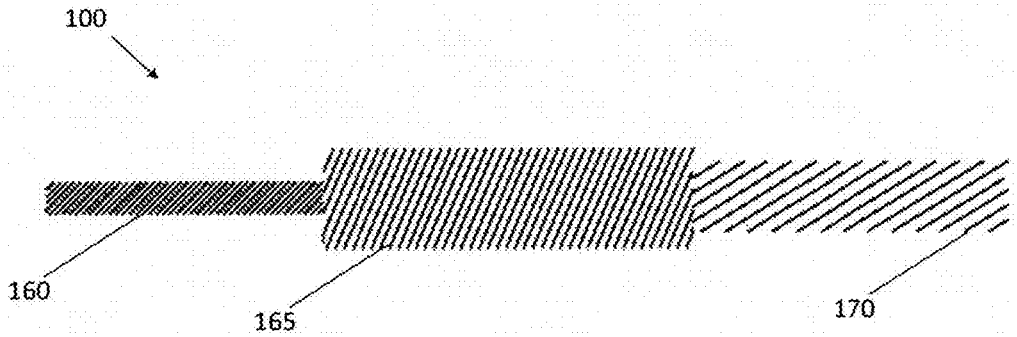
FIG. 10 is a schematic view of an exemplary elongate embroidered element, in accordance with some embodiments of the invention.

An exemplary elongate embroidered element 100 having abrupt changes between stitch properties in different regions of the elongate embroidered element 100 is shown in FIG. 10. In this embodiment, the elongate embroidered element 100 includes a first region 160 having a first width, a first stitch angle, and a first stitch density; a second region 165 having a second width, a second stitch angle, and a second stitch density; and a third region 170 having a third width, a third stitch angle, and a third stitch density. In alternative embodiments any appropriate set of stitch properties and threads can be used in any localized portion of the elongate embroidered element 100, with abrupt or smooth transitions between regions as required.

In addition to varying the stitch arrangement and properties of the elongate embroidered element 100, the embroidery thread being stitched onto the base material can be varied along the length of the elongate embroidered element 100 to change the structural and/or aesthetic properties of the embroidered material. In one embodiment, different regions of the elongate embroidered element 100 can use a different colored thread. FIG. 8B, for example, shows an elongate embroidered element 100 with different thread colors corresponding to different stitch angles (with the high stitch angle "$\alpha_{high}$" region 107 having a first color 130, the low stitch angle "$\alpha_{low}$." regions 106 having a second color 135, and the transition regions 108 having a third color 140. In various embodiments different thread colors can be associated with different structural features and/or simply be used to create a unique aesthetic for the embroidered material. In a further embodiment threads having different material and/or structural properties can have different colors.

The threads can be dyed, or otherwise treated, to an appropriate color prior to embroidering. Alternatively, the threads can be embroidered onto the base material and thereafter dyed, screen printed, or otherwise colored to create the finished color pattern. For example, a thread that is adapted to accept a certain coloring material (e.g., a certain type of dye or pigment) can be embroidered onto a base material that is not affected by that coloring material such that, after embroidering, a pattern can be created on the embroidered thread without affecting the color of the base material itself.

Figure 11:
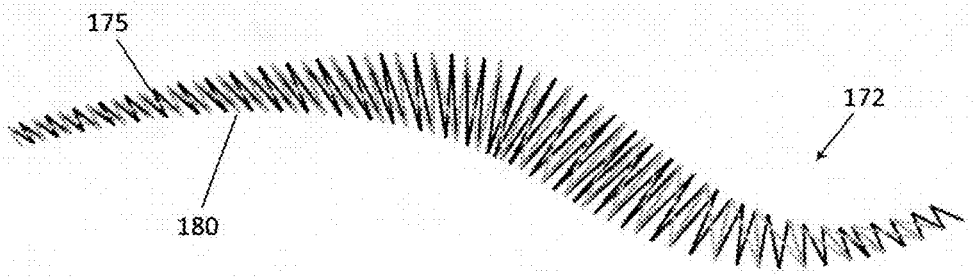
FIG. 11 is a schematic view of another exemplary elongate embroidered element, in accordance with some embodiments of the invention.

In one embodiment, the elongate embroidered element 172 can be formed from two or more threads that are embroidered over each other to create the finished structure. These two or more threads can have the same colors, thread materials and properties, and/or stitch properties or have different colors, thread materials and properties, and/or different stitch properties (in order to create a unique aesthetic and/or structural effect for the layered embroidery regions). FIG. 11, for example, shows an elongate embroidered element 172 having a first thread 175 having a first stitch angle and stitch density with a smoothly changing primary elongate axis and smoothly varying stitch width. A second thread 180 is embroidered over this first thread 175, with the second thread 180 following the same primary elongate axis 105 and having the same smoothly varying stitch width but having a different color, stitch angle, and stitch density. Forming embroidered elements from layered embroidered threads can, for example, increase the strength and other structural properties of the finished elongate embroidered element 100 while also providing a unique aesthetic for the finished embroidery.

One embodiment of the invention includes an embroidered material incorporating two or more different embroidery patterns, with each embroidery pattern including one or more distinct, separate elongate embroidered element. These different embroidery patterns can be laid down separately, one pattern at a time, such that subsequent patterns are embroidered over the underlying patterns to create a multi-element embroidered material, or be embroidered simultaneously using one or more embroidery machine head. Creating an embroidered material using two or more embroidery patterns allows for the formation of materials having localized directional structural properties (e.g., resistance to stretch) in multiple directions, and with different resistance properties in each direction, at a given location. This can allow for the formation of materials that stretch in different ways at different locations on the material when subject to a stretching force in any given direction along the surface plane of the material.

Figure 12:
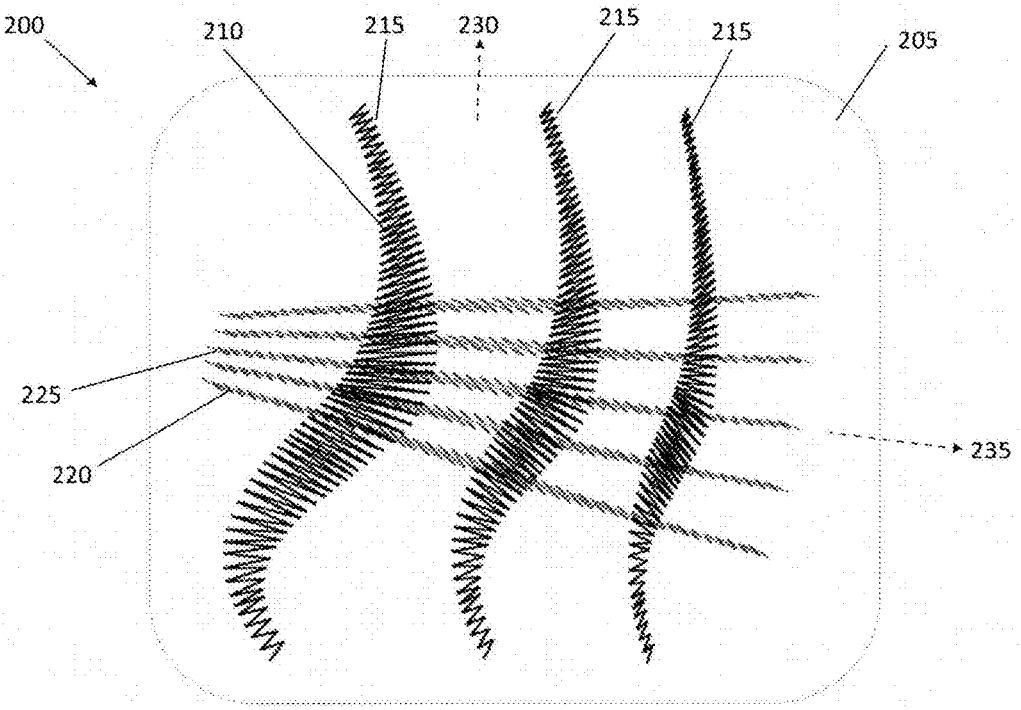
FIG. 12 is a schematic view of a material incorporating a plurality of embroidered patterns, in accordance with some embodiments of the invention.

One exemplary embroidered material incorporating a plurality of embroidery patterns can be seen in FIG. 12. In this embodiment, the embroidered material 200 includes a base layer 205 onto which a first embroidery pattern 210 (including a plurality of first elongate embroidered elements 215) and a second embroidery pattern 220 (including a plurality of second elongate embroidered elements 225) are added. The first embroidery pattern 210 includes first elongate embroidered elements 215 that differ with respect to each other in terms of the exact path of their primary elongate axis and the variation in width over the length of their path, but which are generally oriented with a first primary direction 230 and which relate generally in form to adjacent elongate embroidered elements 215. Similarly, the second embroidery pattern 220 includes second elongate embroidered elements 225 that differ with respect to each other in terms of the exact path of their primary elongate axis and the variation in width over the length of their path, but which are generally oriented with a second primary direction 235 and which relate generally in form to adjacent elongate embroidered elements 225. The second elongate embroidered elements 225 of FIG. 12 cross over the first elongate embroidered elements 215 and diverge in path with respect to each other as they cross adjacent first elongate embroidered elements 215.

In alternative embodiments, each of the first embroidery pattern 210 and second embroidery pattern 220 can include any appropriate arrangement and orientation of elongate embroidered elements, with the physical properties (e.g., the thread material(s), the thread color, the direction of the primary elongate axis, the stitch angle, the stitch density, and the stitch width) of each discrete elongate embroidered element, and the relationship between adjacent elongate embroidered elements, varying depending upon the specific performance requirements of the embroidered material. For example, the density of a group of elongate embroidered elements in a given region of the base material (which is inversely related to the size of the gap between adjacent elongate embroidered elements) can be increased (i.e., by reducing the gap/space between adjacent elements) in regions where a larger change in structural properties (such as an increase in the resistance to stretch) is required. Conversely, the elongate embroidered elements can be spaced farther apart in regions where a smaller change in structural properties is required.

In one embodiment of the invention, the embroidered material can be incorporated into, and form at least a portion of, an upper for an article of footwear such as an athletic shoe, with the specific stricture and arrangement of the embroidery adapted to benefit the athlete wearing the shoe. For example, embroidered upper elements can be specifically configured to provide appropriate structural and performance properties and benefits for a running shoe (such as a track shoe, a road running shoe, or a cross-country running shoe) and/or for the specific type of athletic activity being performed (e.g., sprinting, middle distance running, long distance running, off-road running, etc.). The embroidered upper can be adapted to provide targeted support for predominantly straight line athletic activities and motions (e.g., running) and/or for athletic activities requiring significant cutting or other athletic motions (e.g., basketball, baseball, softball, soccer, American Football, field hockey, ice hockey, ice skating, speed skating, rugby, tennis, squash, racquetball, skateboarding, cycling, etc.) Other athletic motions such as jumping, crouching, kicking, throwing, turning, spinning, etc. can also be accounted for in creating embroidered uppers that enhance or support the unique combination of performance characteristics of a specific athlete and/or activity. In addition, the embroidered upper can be customized to provide support and other performance benefits specifically associated with an individual or with a subset of athletes (e.g., athletes associated with a specific position in a sport such as defenders, midfielders, or attackers in soccer or pitchers, catchers, or fielders for baseball, or athletes having a common physical characteristic, such as weight).

Figure 13:
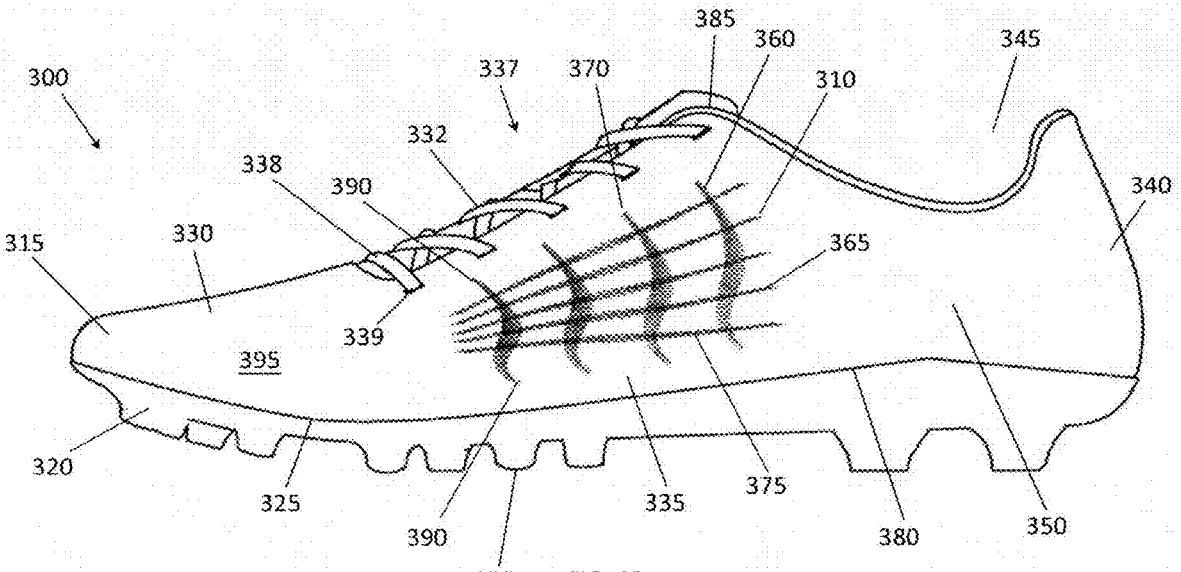
FIG. 13 is a side view of an article of footwear incorporating a plurality of embroidered patterns, in accordance with some embodiments of the invention.

An exemplary athletic shoe 300, in this case a soccer cleat, incorporating an embroidered upper portion 310 is shown in FIG. 13. The shoe 300 includes an upper 315 with a sole 320 attached to a bottom portion 325 thereof. The shoe 300 includes a forefoot region 330, a midfoot region 335, a heel region 340, and an opening 345 into which a foot can be received. The shoe further includes a lateral side 350 and a medial side (not shown). The sole 320 includes a resilient plate (e.g., a TPU, nylon, and/or EVA plate) including an arrangement of cleated traction elements 355. In an alternative embodiment, the sole 320 could include a midsole formed from a material (e.g., a ground contact EVA) having appropriate performance, traction, wear, and durability characteristics to allow it to be used as the ground-contacting surface of a shoe sole. In an alternative embodiment, one or more outsole elements (e.g., a rubber outsole element) may be attached to the lower surface of the midsole to provide the appropriate ground contacting characteristics for the shoe 300.

The shoe 300 also includes a shoe closure system 332 in the midfoot region 335 at the top of the instep 337 including a lacing element 338 extending through a plurality of lace holes 339. In alternative embodiments, any appropriate shoe closure system may be utilized such as, but not limited to, a hook and loop closure system, a strap-type closure system, or any other appropriate footwear closure system as known in the art. In one embodiment, the upper 315 may be a slip-on construction and may, for example include a booty-type construction that extends elastically over the top of the midfoot of a wearer in the midfoot region 335 of the shoe to hold the foot within the shoe without the need for a separate closure system.

Here, the embroidered upper portion 310 forms a localized portion of the midfoot region 335 of the upper 315 of the athletic shoe 300, with the remainder of the upper 315 free from embroidery. In an alternative embodiment, the upper 315 can have one or more localized embroidered upper portions 310 in any appropriate portion of the shoe 300, or have an embroidered upper portion 310 that covers all, substantially all, or a majority of the upper 315. The embroidered upper portion 310 includes a first embroidery pattern 360 and a second embroidery pattern 365. The first embroidery pattern 360 includes four elongate embroidered elements 370 extending along a smoothly curving primary elongate axis from a region proximate the bottom portion 325 of the upper 315 to a region proximate the shoe closure system 332, thereby providing additional strength and resistance to stretch for the upper around the midfoot 335 to ensure a tight and stable fit for the upper in that region upon tightening the shoe 300 on the foot. The second embroidery pattern 365 crosses the first embroidery pattern 360 and includes five elongate embroidered elements 375 extending through the midfoot region 335 in a diverging pattern in a direction extending substantially from the forefoot 330 to the heel 340 of the shoe 300, with these elongate embroidered elements 375 providing support and resistance to stretch for the upper substantially in the direction of the longitudinal axis of the shoe.

In the embodiment of FIG. 13, the embroidered upper portion 310 doesn't extend to an edge of the upper 315 (i.e., it is localized within a region of the upper 315 away from both the lower edge 380 at the bottom portion 325 of the upper proximate the sole 320 and the upper edge 385 proximate the shoe closure system 332 and foot opening 345. In an alternative embodiment, one or more embroidery pattern can include one or more elongate embroidery element that extends to one or more edge of the upper 310 and, in certain embodiments, each of the elongate embroidery elements in one or more embroidery pattern can include one or both distal ends 390 that end at an edge of the upper 315.

The shoe 300 of FIG. 13 includes two embroidery patterns 360, 365 that are embroidered onto the base material 395 of the upper 315 one layer at a time in an overlaid arrangement. In alternative embodiments, the embroidered upper can include only a single embroidery pattern, or include three or more embroidery patterns overlaid over each other, or include a plurality of different embroidery patterns located at different regions of the upper 315 and either partially overlaying each other or being separated and not overlaying each other.

Figure 14:
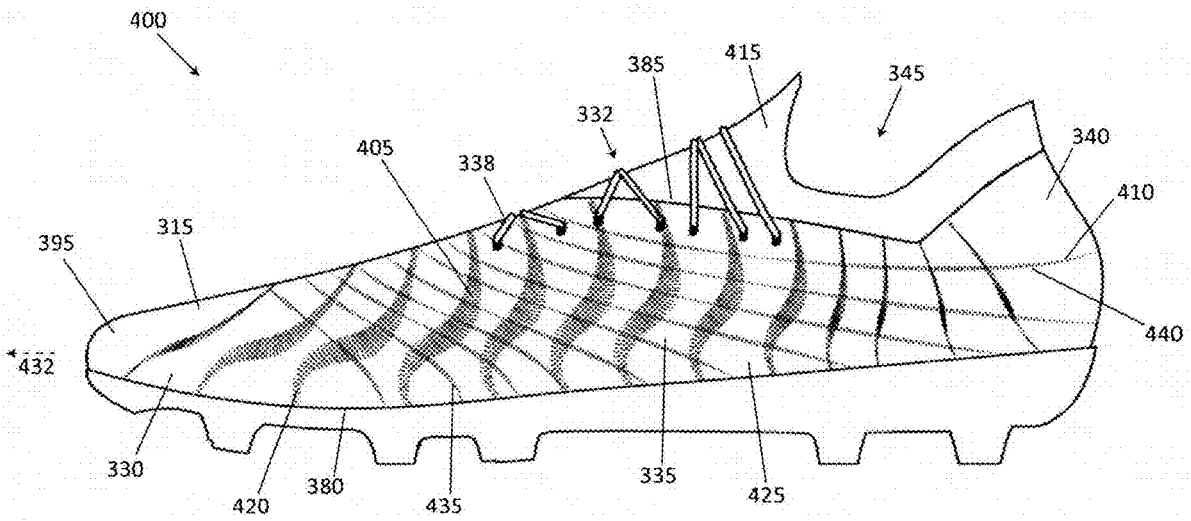
FIGS. 14 and 15 are medial and lateral side views of another article of footwear incorporating a plurality of embroidered patterns, in accordance with some embodiments of the invention.
Figure 15:
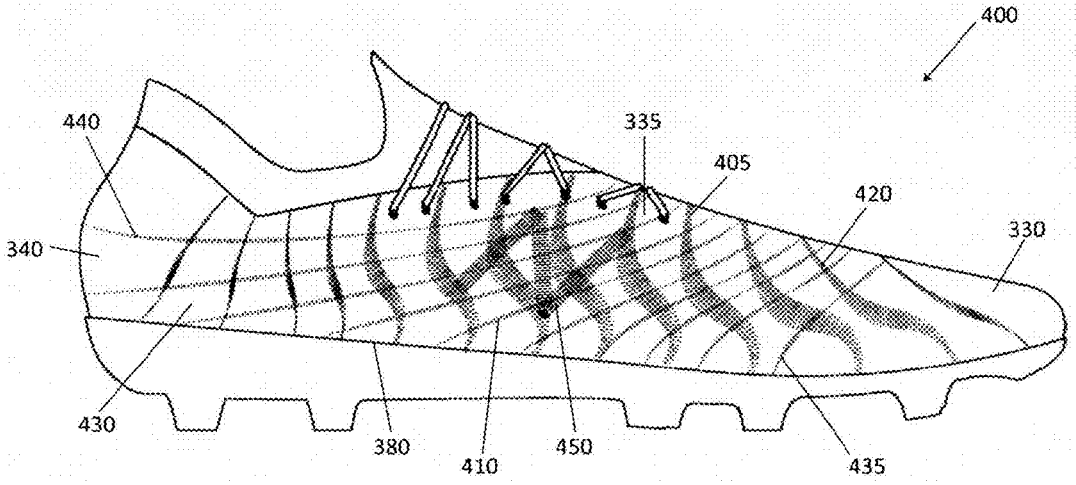

An exemplary shoe 400 having a first embroidery pattern 405 and second embroidery pattern 410 overlaid on a base layer 395 of an upper 315 and extending over substantially all of the upper 315 is shown in FIGS. 14 and 15. In this embodiment, the shoe 400 includes a shoe closure system 332 including a lace 338 extending over a bootie-type collar 415 in the foot opening region 345. The bootie-type collar 415 can be formed from an elastic or inelastic material and can, for example, be formed from a stretchable knit material or a synthetic leather material.

The first embroidery pattern 405 includes a plurality of first elongate embroidered elements 420 that extend up from the lower edge 380 of the upper 315 and either extend up to the upper edge 385 (between the main body of the upper 315 and the bootie-type collar 415) proximate the shoe closure system 332 and foot opening 345 (in the heel region 340 or the back part of the midfoot region 335) or extend over the top of the shoe 400 and therefore extend as a single element from the lower edge 380 on the medial side 425 to the lower edge 380 on the lateral side 430 (in the front part of the midfoot region 335 and in the forefoot region 330). Each of the first elongate embroidered elements 420 are oriented generally substantially perpendicularly to the longitudinal axis 432 of the shoe 400, with the specific direction of the primary elongate axis of each first elongate embroidered element 420 changing smoothly along its length. The local width "w" of each first elongate embroidered element 420 also varies smoothly along its length. The exact direction of the primary elongate axis of each first elongate embroidered element 420 differs between each adjacent first elongate embroidered element 420 such that the embroidered pattern 405 forms an ordered group of discrete elongate embroidered elements 420 but with different structural properties created by the embroidery in different regions of the upper 315.

In one embodiment, one or more embroidery pattern can extend into at least a portion of the bootie-type collar 415. In certain embodiments, the base material can be formed from a single unitary piece of material. In an alternative embodiment, the base material can be formed from a plurality of material portions stitched, bonded, or otherwise connected together, with the embroidery extending over at least some of the plurality of material portions.

The second embroidery pattern 410 includes a plurality of second elongate embroidered elements 435 that extend over the upper 315 in a different pattern and direction to the first embroidery pattern 405. More particularly, the second embroidery pattern 410 includes a number of second elongate embroidered elements 435 that extend over the top of the shoe 400 and therefore extend as a single element from the lower edge 380 on the medial side 425 to the lower edge 380 on the lateral side 430 (in the front part of the midfoot region 335 and in the forefoot region 330), and a number of second elongate embroidered elements 440 that extend around the upper 315 in a closed loop without extending to an edge of the upper 315. In alternative embodiments, any combination of closed loop elongate elements and open loop elements that do or do not extend to one or more edges of the upper can be used.

The second elongate embroidered elements 440 extend in a path substantially parallel to the longitudinal axis of the shoe 400 in the heel region 340, thereby providing resistance to stretch in that direction around the heel. The second elongate embroidered elements 435 meanwhile extend more vertically over the top of the shoe 400, thereby providing resistance to stretch around the midfoot region 335 to assist in the secure fit of the shoe 400.

The second elongate embroidered elements 435 have an average width that is smaller than the average width of the first elongate embroidered elements 420, and have a smaller maximum width than the maximum width of the first elongate embroidered elements 420. As a result, the second embroidery pattern 410 has a smaller effect on the stretch properties of the upper 315 than the first embroidery pattern 405.

In an alternative embodiment, one or more of the elongate embroidered elements in an embroidery pattern may curve along at least a portion of their primary elongate axis while one or more of the embroidery elements may be straight, or substantially straight, along the entire length of its primary elongate axis. In one embodiment, certain adjacent, or non-adjacent elongate embroidered elements can have the same direction of their primary elongate axis along their length, or a portion thereof, while other elongate embroidered elements within the embroidery pattern have a different primary elongate axis direction.

The shoe 400 also includes a third embroidery pattern 450 on the lateral side 430 in the midfoot region 335 of the upper 315. More particularly, the third embroidery pattern 450 is a localized brand logo/identifying mark. In alternative embodiments, any graphical and/or alphanumerical brand identifying mark, aesthetic feature, and/or other structural element may be formed from an embroidered pattern on the upper 315.

By forming embroidery patterns from a plurality of discrete, separate, spaced elongate elements, each of which have a defined structure including a primary elongate axis having a potentially varying direction along its length, a potentially varying width, and a consistent or potentially varying stitch density and stitch angle, the embroidery patterns can be configured to provide highly directional and highly localized structural support and elasticity to a shoe upper without substantially changing the structural properties of the upper material in different directions of stretch and at different portions of the material. In contrast, traditional embroidery, whether used to provide a unique aesthetic to the material and/or more global structural support for the material, cannot provide the customized and uniquely localized structural benefits that are achievable through the application of the one or more embroidery patterns described herein.

In one embodiment one or more embroidery patterns may be patterned to align with, support, and/or stabilize one or more structural and/or performance characteristic of an article of footwear during a specific athletic motion. By utilizing two or more distinct embroidery patterns on the upper of an article of footwear the upper can therefore be configured to support two or more specific athletic motions with the minimum of added material and without substantially restricting the stretch and flexibility of the material in regions and in directions other than that targeted by the embroidery pattern(s). For example, physical and/or optical measurements of stress and/or strain at various portions of the shoe upper during a specific athletic motion can be used to determine optimal regions and directions for the positioning and orientation of material portions such as patterns of discrete embroidery elements, with the direction and magnitude of the forces measured at each portion of the upper determining the direction of the primary elongate axis, the width of each embroidered element, the density of groups of discrete embroidered elements within a region (controlled by the gap between adjacent elements) and even the stitch angle and stitch density at each localized region of the upper.

Figure 16A:
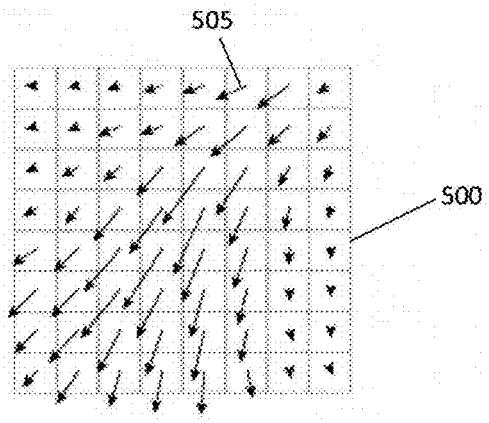
FIGS. 16A through 16D represents a method of creating an embroidery pattern, in accordance with some embodiments of the invention.

FIGS. 16A through 16D show an exemplary method of identifying and designing an embroidery pattern based on experimental or theoretically modelled force or strain data on a material when subject to a specific physical action (such as a portion of an upper material for a shoe being subject to stress/strain during an athletic motion). FIG. 16A shows a grid 500 mapping a material portion, with measured or calculated force vectors 505 mapped onto the grid 500 identifying the magnitude (indicated by the length of the vector 505) and direction (indicated by the direction of the vector 505) of a force or strain applied to the material during a physical event at each position within the grid 500. The force vectors may represent an average of the magnitude and direction of the force over a period of time, a single force value at a single point in time, or a specific sample (e.g., the sample associated with the maximum fore measured) over a period of time, depending upon the specific requirements of the modelled results.

Figure 16B:
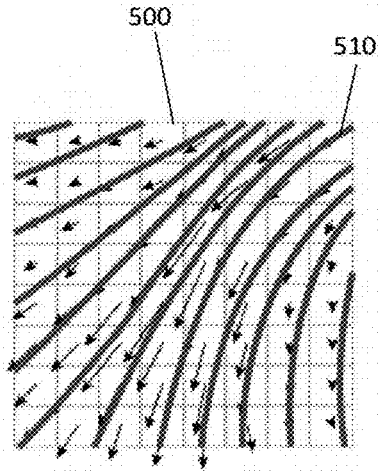
Figure 16C:
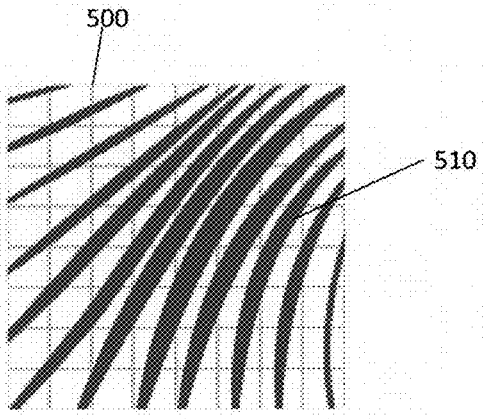
Figure 16D:
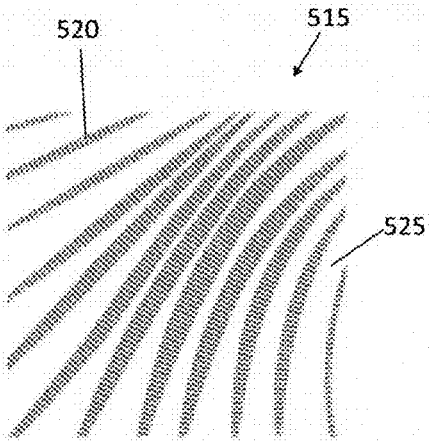

This map of force vectors 505 can then be used to calculate and create a map for a plurality of discrete contour lines 510, with the contour lines 510 following the path of the force vectors 505 over the grid 500, as shown in FIG. 16B. The thickness of the contour lines 510 at a specific location along its length can be calibrated with respect to the magnitude of the force vectors proximate the contour lines 510, with wider/thicker contour lines 510 corresponding to larger force vectors 505 proximate specific regions along the contour lines 510 and narrower/thinner contour lines 510 corresponding to smaller contour lines 510 proximate other specific regions along the contour lines 510. In addition, a density of the contour lines 510 in a given region (or the gap between adjacent contour lines 510 in a given region) can also be controlled by the magnitude of the force vectors 505 proximate those contour lines 510, with a higher density of contour lines 510 (i.e., with a smaller gap between contour lines 510) corresponding to regions of larger force vector 505 magnitudes.

Once appropriate contour lines 510 have been created based upon the measured or calculated force vectors 505, an embroidery pattern 515 can be designed and manufactured with discrete elongate embroidered elements 520 mapped to the generated contour lines 510. When applied to a base material 525 this embroidery pattern 515 provides precisely targeted performance properties (e.g., structural support and resistance to stretch) to the finished embroidered material that is optimized to provide support and stretch resistance in the directions required with the minimum of additional material and without negatively affecting the properties of the material in other directions and in other areas of the material. In various embodiments, any appropriate experimental data sets and/or theoretically modelled data sets can be used to determine the properties of the discrete elongate embroidered elements 520 forming the embroidery pattern 515 to form materials customized for a specific sport, athletic motion, and/or athlete (or group of athletes). Exemplary methods of capturing and processing data for use in generating optimized structural and performance characteristics for an embroidered material for incorporating into an athletic shoe are described in U.S. Patent Publication Nos. US 2014-0182170 and US 2015-0351493, the disclosures of which are incorporated herein by reference in their entirety.

Figure 17A:
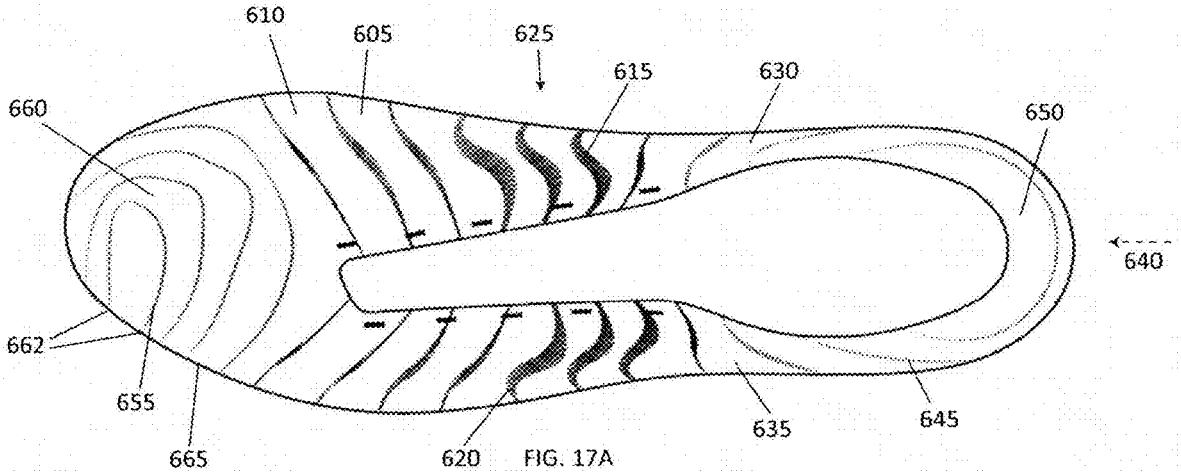
FIG. 17A is a top view of an upper incorporating a first embroidery pattern, in accordance with some embodiments of the invention.
Figure 17B:
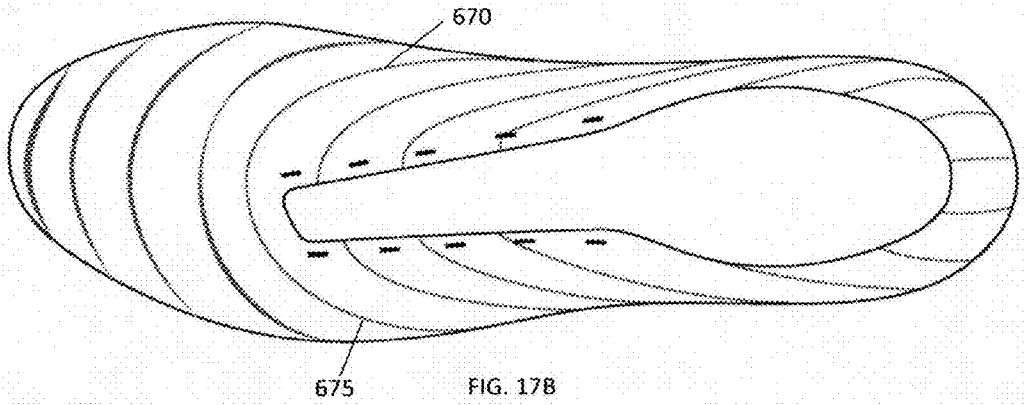
FIG. 17B is a top view of an upper incorporating a second embroidery pattern, in accordance with some embodiments of the invention.
Figure 17C:
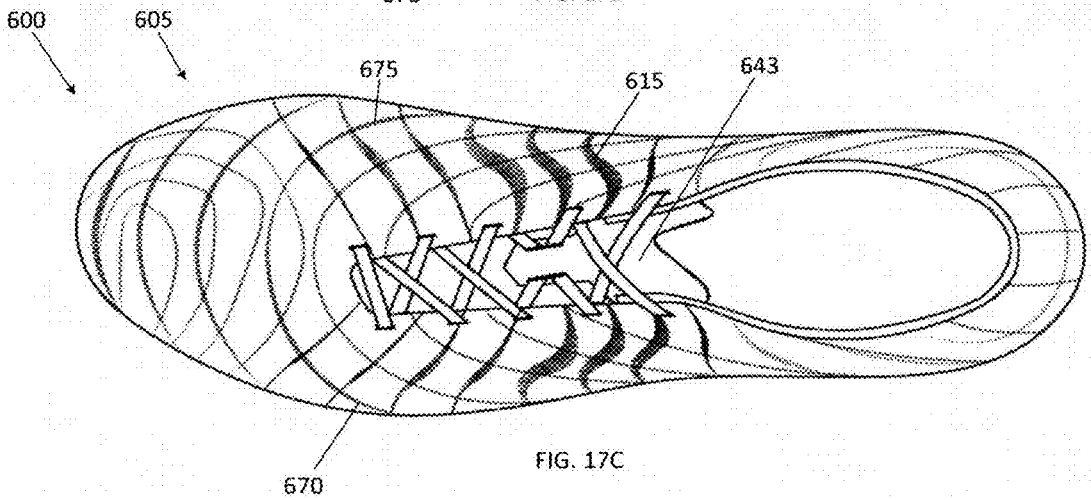
FIG. 17C is a top view of a shoe incorporating the embroidery patterns of FIGS. 17A and 17B.

In one embodiment of the invention, as shown in FIGS. 17A through 17C, an athletic shoe 600 can be formed with an upper 605 having a base layer 610 with two separate embroidery patterns embroidered onto the base layer 610 to form the finished upper 605. The first embroidery pattern 615, as shown in FIG. 17A, is calculated and designed from force/stress/strain data relating to a first athletic motion, in this case a cutting motion where an athlete is moving substantially sideways and rapidly changing direction by planting her foot and pushing off in a direction substantially or at least partially opposed to the direction of the athlete prior to planting her foot. The first embroidery pattern 615 includes a plurality of smoothly curving elongate embroidered elements 620 extending in a midfoot portion 625 of the shoe 600 on both the medial side 630 and the lateral side 635 in a general perpendicular direction to the longitudinal axis 640 of the shoe 600, thereby providing structural stability and support for the lacing region 643 of the shoe 600. The first embroidery pattern 615 further includes a plurality of smoothly curving elongate embroidered elements 645 extending within and around a heel portion 650 of the shoe 600 on both the medial side 630 and the lateral side 635, with at least one of the elongate embroidered elements 645 extending around the heel portion 650 to provide support for the heel portion 650. The first embroidery pattern 615 further includes a plurality of smoothly curving elongate embroidered elements 655 extending within a forefoot portion 660 of the shoe 600 on both the medial side 630 and the lateral side 635, with at least one of the elongate embroidered elements 655 extending at both ends 662 from a lateral edge 665 of the upper 605, the forefoot elongate embroidered elements 655 adapted to provide support and directional resistance to stretch on the forefoot region 660.

The average and maximum widths of the elongate embroidered elements differ between the forefoot region 660, midfoot region 625, and heel region 650, with the largest maximum and largest average width being found in the midfoot region 625. In alternative embodiments, any one or more of a medial and/or lateral forefoot region, midfoot region, and/or heel region can incorporate elongate embroidered elements having a greater average and/or maximum width than those in other regions of the upper. In addition, certain embodiments can include one or more elongate embroidered elements that extend from a medial edge to a lateral edge of the upper, or from a medial or lateral edge to a lacing/foot opening edge of the upper, or have both ends extending to either the medial edge, lateral edge, forefoot edge, or heel edge. Certain elongate embroidered elements can also extend in open or closed loops that do or do not extend to an edge of the upper. In one embodiment, each of the discrete elongate embroidered elements in an embroidery pattern are separated and do not cross or otherwise touch. In an alternative embodiment, two or more of the elongate embroidery elements can branch off from a single elongate embroidery element to form a branching web-like structure.

The shoe 600 further includes a second embroidery pattern 670, as shown in FIG. 17B. The second embroidery pattern 670 is calculated and designed from force/stress/strain data relating to a second athletic motion different from the first athletic motion, in this case a breaking motion during straight line running where an athlete is moving substantially forwards in a sprint and plants his or her foot to stop rapidly. The second embroidery pattern 670 includes a plurality of smoothly curving elongate embroidered elements 675 that differ in their arrangement and physical properties from the elongate embroidered elements of the first embroidery pattern 615 due to the differences in the forces/stresses/strains being accounted for by the second embroidery pattern 670. In various embodiments, depending upon the specific sport, athletic motion, athlete (or group of athletes), etc., any two or more athletic motions can be supported by two or more distinct embroidery patterns.

The first embroidery pattern 615 and second embroidery pattern 670 are combined on the upper 605 to form the finished shoe 600, with either of the first embroidery pattern 615 and second embroidery pattern 670 being laid down first, and with the other pattern embroidered over it. In an alternative embodiment, the first embroidery pattern 615 and second embroidery pattern 670 can be embroidered at the same time, either using two embroidery heads or by creating a combined pattern that allows for the formation of the two patterns as a single web-like structure.

Figure 18A:
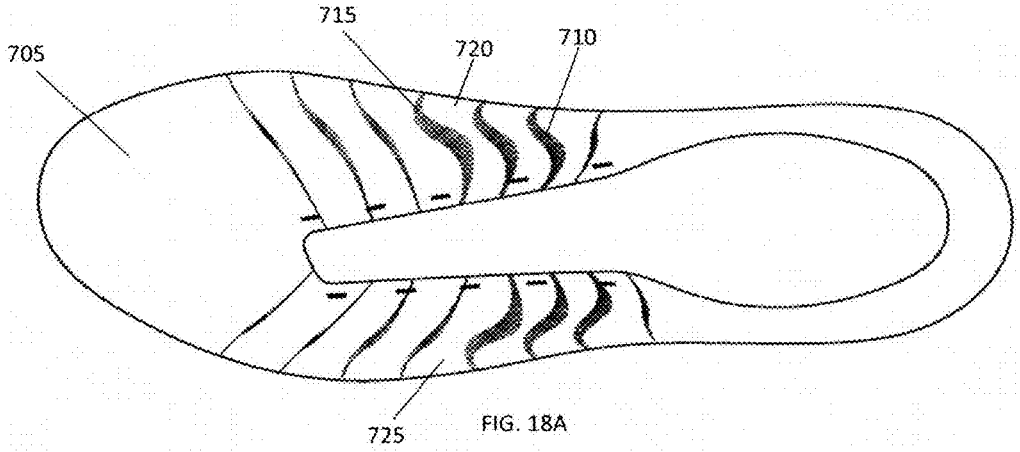
FIG. 18A is a top view of another upper incorporating a first embroidery pattern, in accordance with some embodiments of the invention.
Figure 18B:
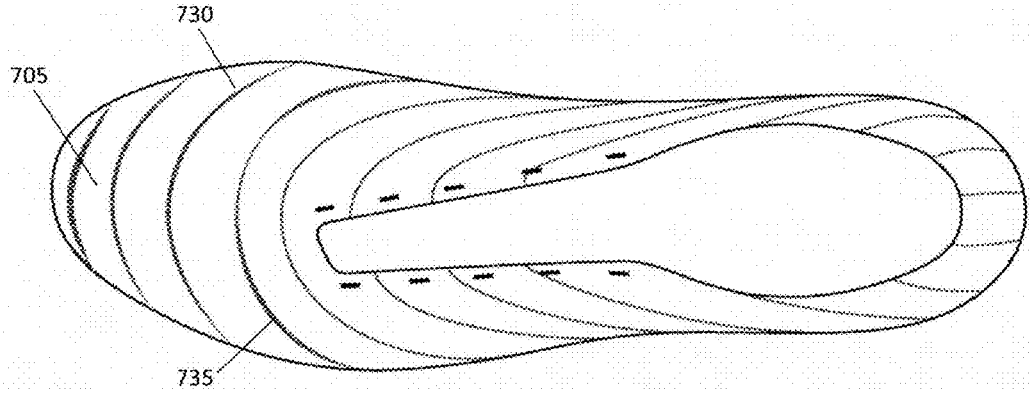
FIG. 18B is a top view of another upper incorporating a second embroidery pattern, in accordance with some embodiments of the invention.
Figure 18C:
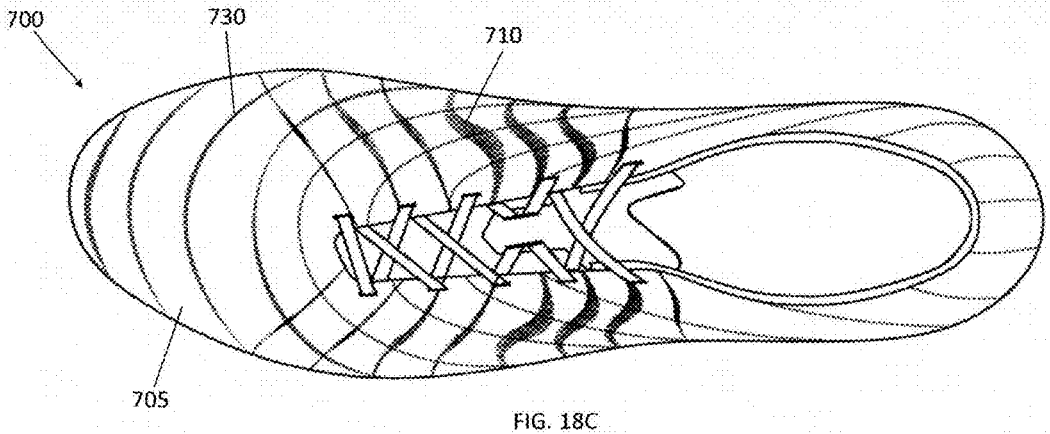
FIG. 18C is a top view of a shoe incorporating the embroidery patterns of FIGS. 18A and 18B.

In one embodiment, one or more first embroidery patterns can be formed in only a limited region, or limited regions, of the shoe upper, while one or more second embroidery patterns are formed in different regions that do or do not overlap with the firsts embroidery pattern(s) or extend over the entire, or substantially the entire, upper. For example, FIGS. 18A though 18C show an exemplary shoe 700 upper 705 including a first embroidery pattern 710 that is formed from a plurality of first elongate embroidered elements 715 positioned in the medial midfoot region 720 and lateral midfoot region 725, and a second embroidery pattern 730 that is formed from a plurality of second elongate embroidered elements 735 positioned over substantially all of the upper 705. The resulting shoe 700 thereby provides an upper 705 having overall directional, customized support provided by the second embroidery pattern 730, and with additional targeted support in the midfoot of the shoe 700 as provided by the first embroidery pattern 710.

An exemplary system for forming a shoe having a plurality of distinct, directional embroidery patterns thereon is shown in FIGS. 19A through 21B. In this embodiment, experimental data are gathered from an athlete in a test shoe using advanced data gathering techniques and equipment. The data can, for example, be captured by a 3D measurement tool such as a digital image correlation system (and, for example an ARAMIS® Digital Image Correlation System provided by Trilion Quality Systems LLC of Plymouth Meeting, Pa., U.S.A.) which can be used to capture and analyze material and component behavior of a shoe upper during dynamic athletic activity. The digital image correlation system is a non-contact and material independent measuring system providing high resolution images, and highly accurate information about a component's 3D shape, as well as strain and deformation response for a test article subject to a load or force, and provides a contour map of strain and deformation information on the material being examined. In an alternative embodiment, the experimental data can be captured by strain gauges, extensometers, accelerometers, LVDTS, laser trackers, laser scanners, scanning laser vibrometers, and/or other deformation tools.

Figure 19A:
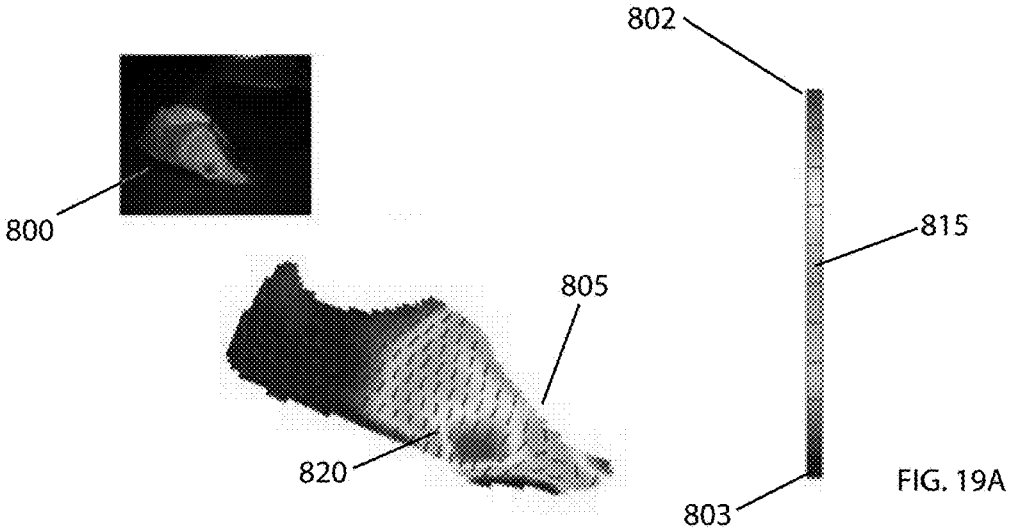
FIGS. 19A through 21B show a method of determining a plurality of embroidery patterns for a footwear upper based on experimental data, in accordance with some embodiments of the invention.
Figure 19B:
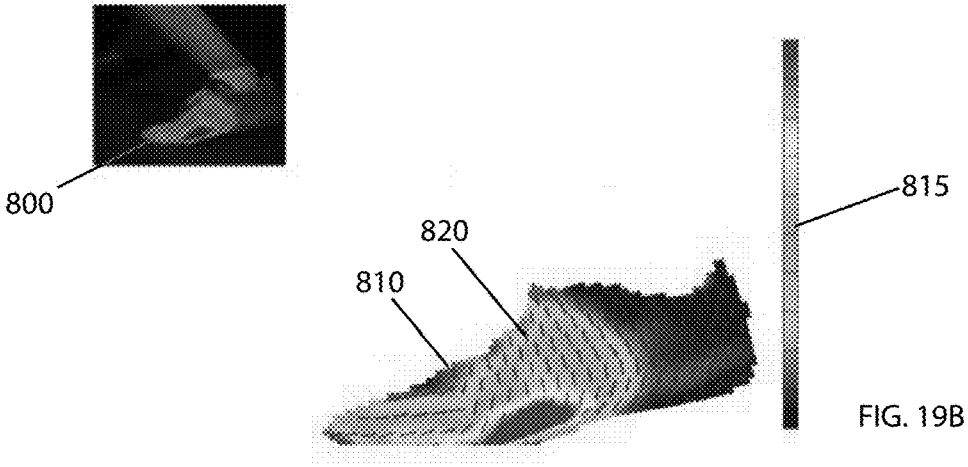
Figure 19C:
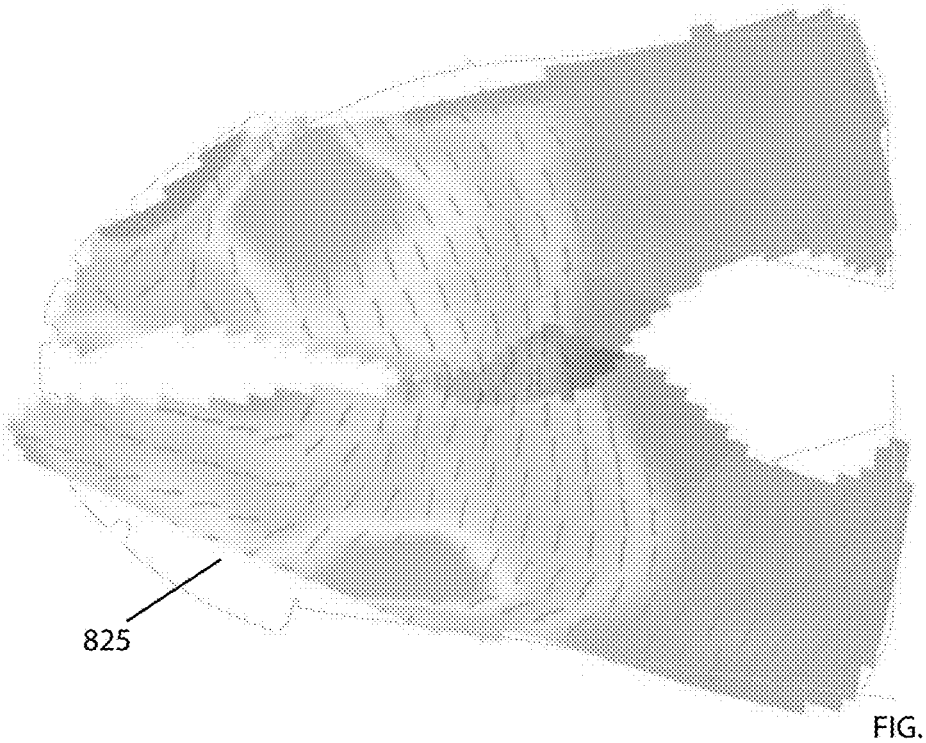

In operation, an athlete performs a first athletic motion (e.g., a cutting motion) and experimental data are captured and analyzed to produce a map of strain magnitudes and directions over the surface of the athletes test shoe during the athletic motion. FIG. 19A shows a contour and vector map of strain magnitudes and directions on a medial side 805 of a shoe 800, while FIG. 19B shows data captured for a lateral side 810 of the shoe 800 during the same motion. The data include a color scale 815 indicating the magnitude of the measured strain at all measured locations on the shoe 800, with the highest magnitudes indicated by a first color 802 (e.g. red) and the lowest magnitudes indicated by a second color 803 (e.g., blue) with a range of different colors and shades therebetween. In addition, vectors 820 indicate the direction of the measured strain at a grid (either a regular or irregular grid) of locations over the shoe 800. The data for the medial side 805 and lateral side 810 can then be combined to give a full data map 825 of strain magnitude and direction as measured during the first athletic motion.

Figure 20A:
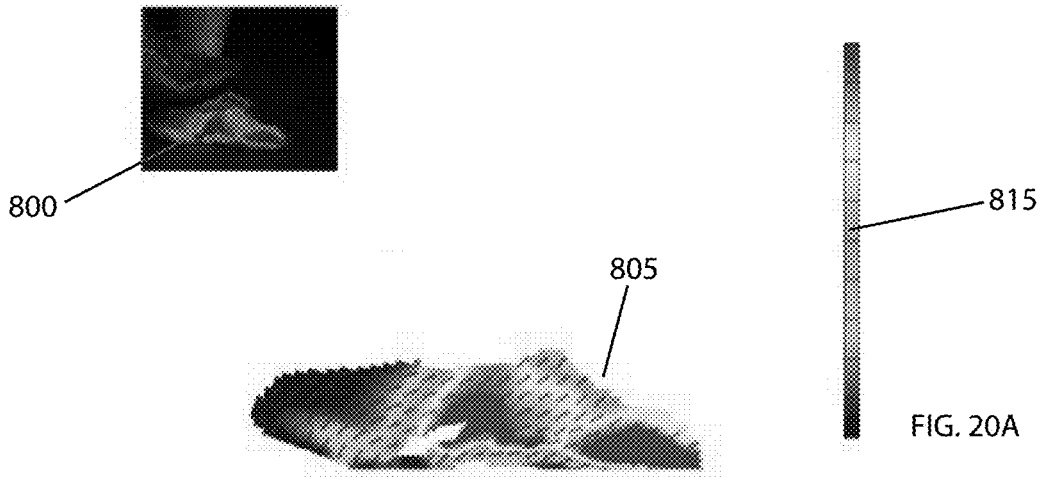
Figure 20B:
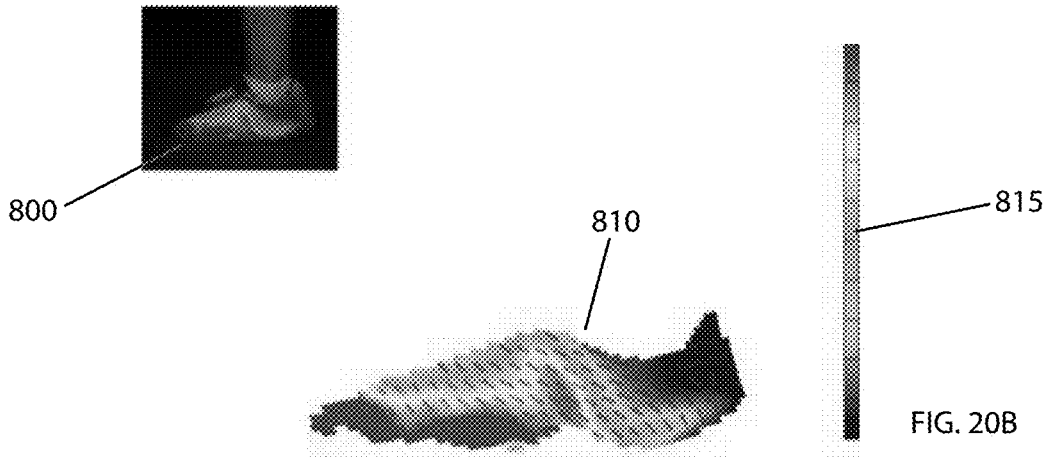
Figure 20C:
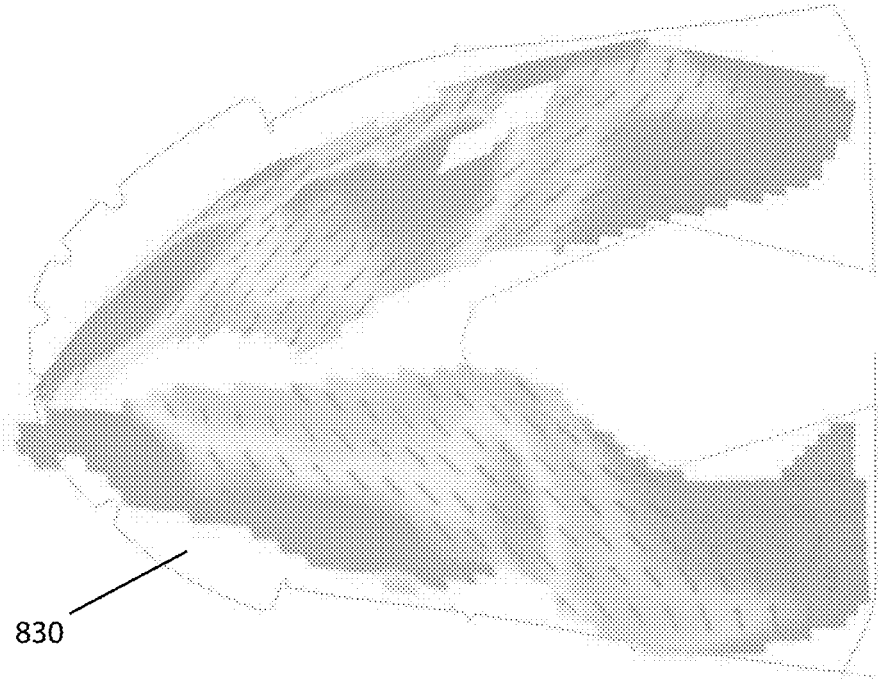

Similarly, a data map 830 of strain magnitudes and directions over the surface of the athletes test shoe during a second athletic motion (e.g., a breaking motion—i.e. a motion where an athlete plants his or her foot to stop quickly when running forward) can be generated from contour and vector maps of strain magnitudes and directions on a medial side 805 of a shoe 800 (as shown in FIG. 20A) and the lateral side 810 of the shoe 800 (as shown in FIG. 20B), with the resulting data map 830 providing an indication of strain magnitude and direction as measured during the second athletic motion. In various embodiments the data can be processed from a single representative data sample or from an averaged or otherwise processed group of samples. In addition, the data can be captured and processed for a single athlete or for a group of athletes.

Figure 21A:
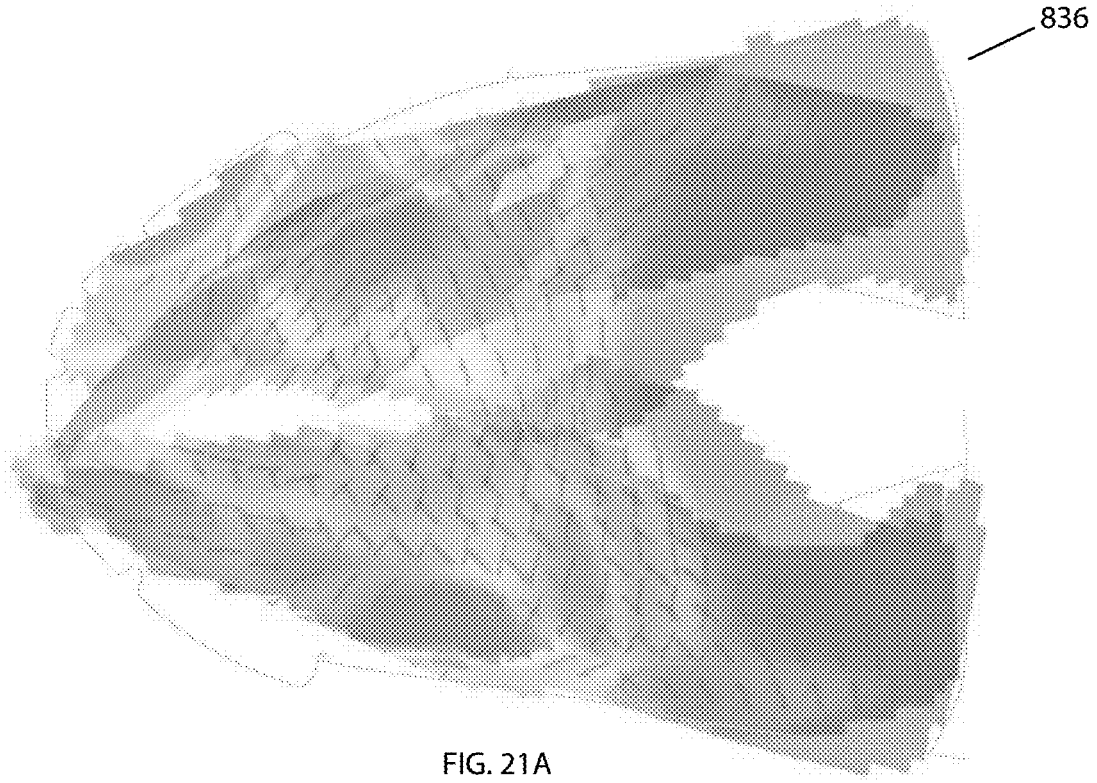
Figure 21B:
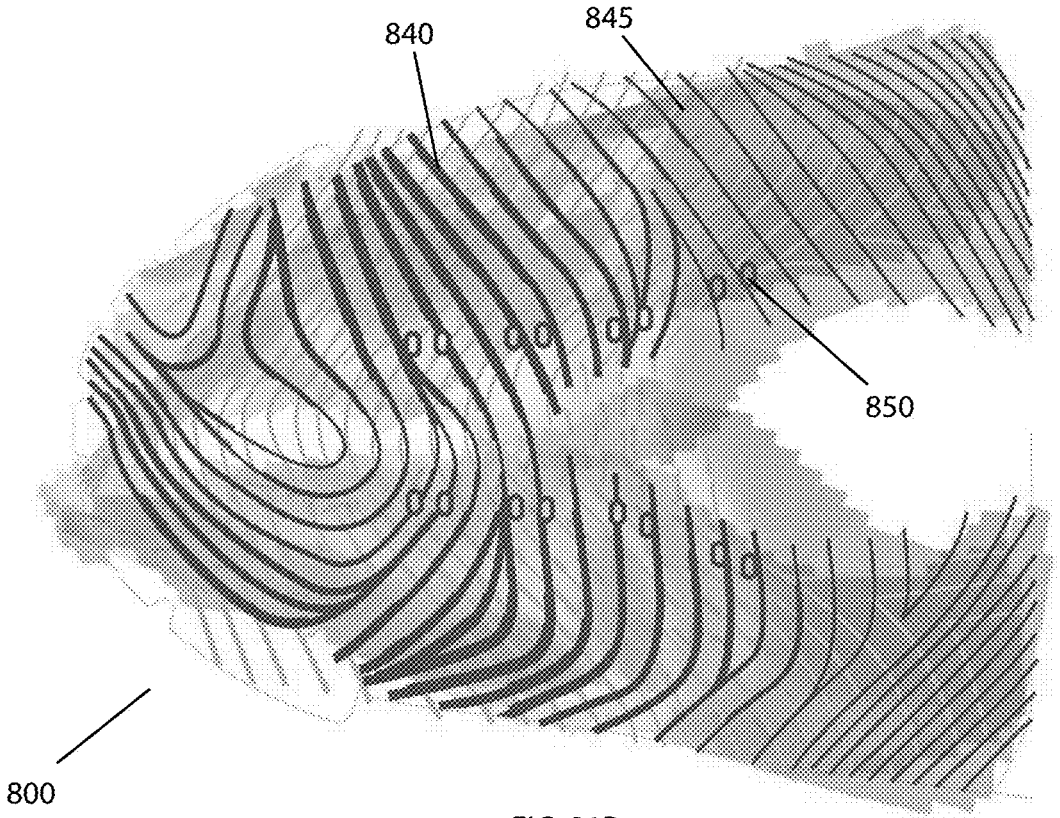

Once data maps have been calculated for both athletic motions, these maps can be combined (as shown in FIG. 21A) to provide an overall map 836 of the magnitudes and directions of strain applied to a shoe during representative athletic motions for a specific sport or other athletic activity. The two separate contour maps 825, 830 can then be used to create distinct, overlaid, embroidery patterns for a shoe 800, with a first embroidery pattern 840 created based on the first data map 825, and the second embroidery pattern 845 formed based on the second data map 830, as shown in FIG. 21B. Other structural elements, such as lace loop support holes 850 can also be designed and embroidered into the upper of the shoe 800.

In various embodiments the specific athletic motion, or motions, to be accounted for and supported by the layer, or layers, of patterned embroidered elements can be selected to represent the most important and/or most high impact motions carried out by an athlete during any particular sport or sports. These motions may include various cutting motions, breaking motions, accelerating/pushing-off motions, turning motions, foot planting motions, jumping motions, or other motions used predominantly in one or more sports. The resulting patterns of embroidery on a given shoe will therefore potentially vary greatly depending on the specific data captured for a given sport.

Figure 22A:
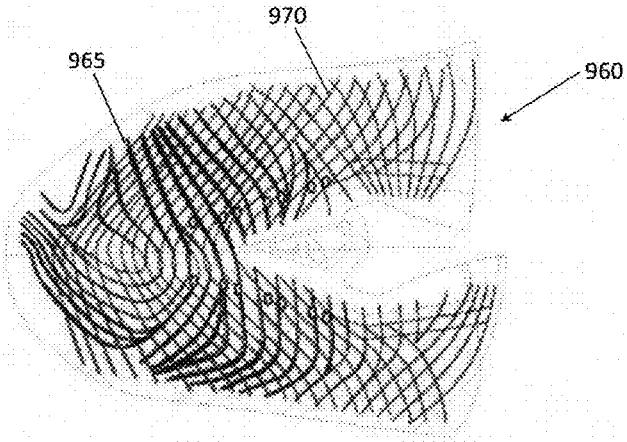
FIG. 22A is a top view of a footwear upper shell incorporating two embroidery patterns, in accordance with some embodiments of the invention.
Figure 22B:
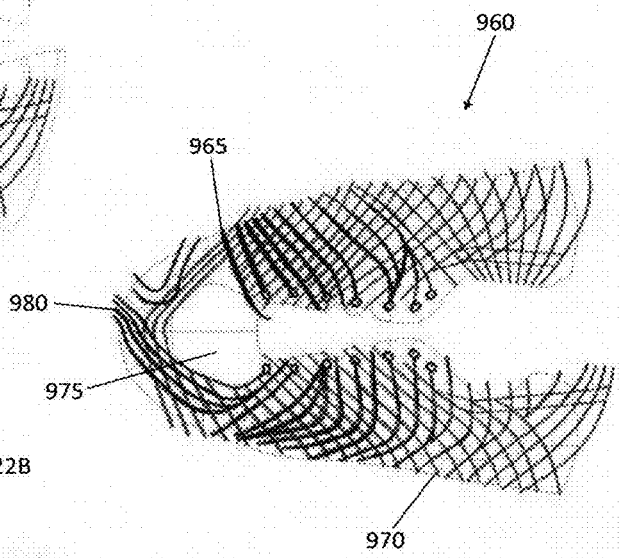
FIG. 22B is a top view of another footwear upper shell incorporating two embroidery patterns, in accordance with some embodiments of the invention.
Figure 22C:
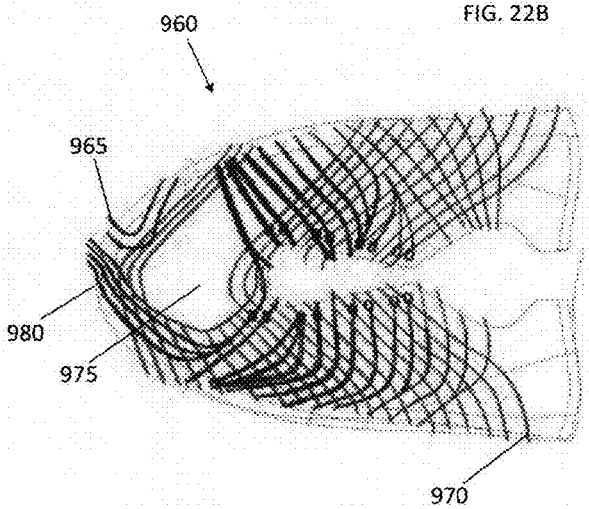
FIG. 22C is a top view of another footwear upper shell incorporating two embroidery patterns, in accordance with some embodiments of the invention.
Figure 22D:
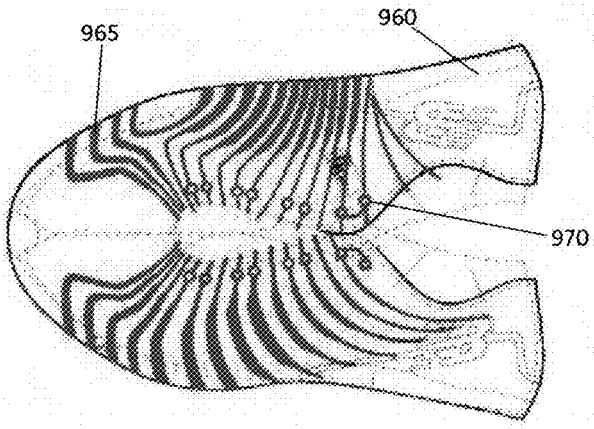
FIG. 22D is a top view of another footwear upper shell incorporating two embroidery patterns, in accordance with some embodiments of the invention.

Exemplary arrangements of appropriate embroidery patterns for different sports can be seen in FIGS. 22A through 22D, with FIG. 22A showing a shell for an upper 960 including a first embroidery pattern 965 (having a first color) and a second embroidery pattern 970 (having a second color), with FIG. 22A showing an example embroidery arrangement for football, FIG. 22B showing an exemplary embroidery arrangement for tennis, and FIG. 22C showing an example embroidery arrangement for a training shoe. As can be seen in FIGS. 22B and 22C, depending upon the particular sport and athletic motions being addressed, certain embroidery arrangements can have patterns 965, 970 that span the majority of the upper 960, but that leave certain regions (e.g., the central forefoot region 975 behind the toe region 980) substantially free from embroidery. FIG. 22D shows an embroidery arrangement for a trail running shoe with the a first embroidery pattern 965 addressing a first athletic motion (in this case a foot strike during trail running) and the second embroidery pattern 970 providing lace loop supports.

Figure 23A:
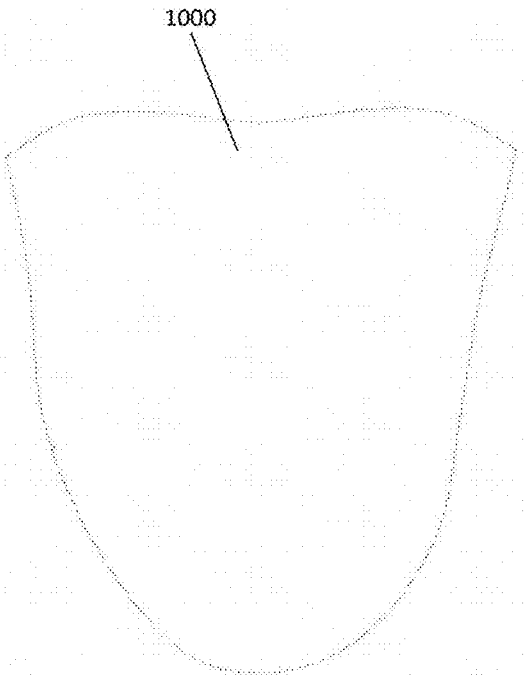
FIGS. 23A through 23D are top views of a plurality of layers of a multi-layered embroidered footwear upper shell, in accordance with some embodiments of the invention.
Figure 23B:
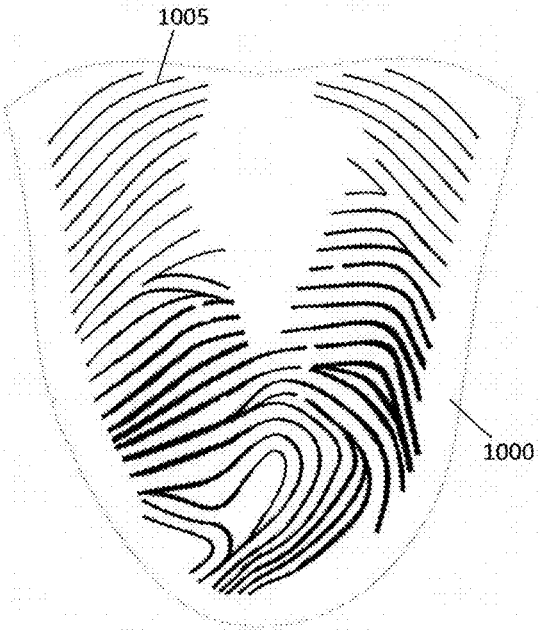
Figure 23C:
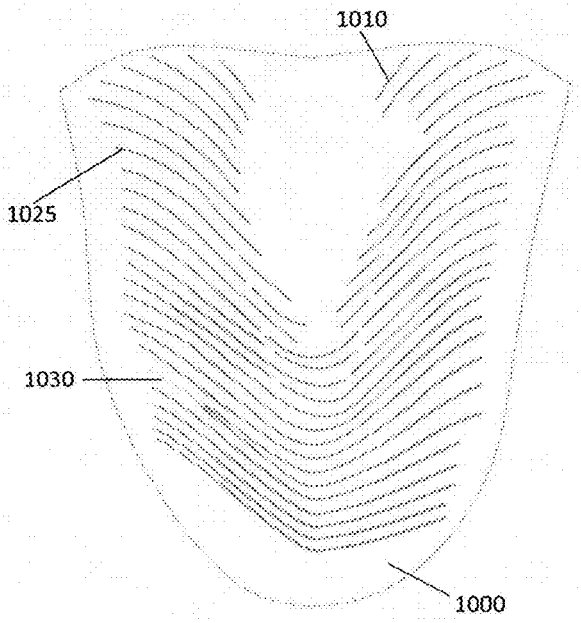
Figure 23D:
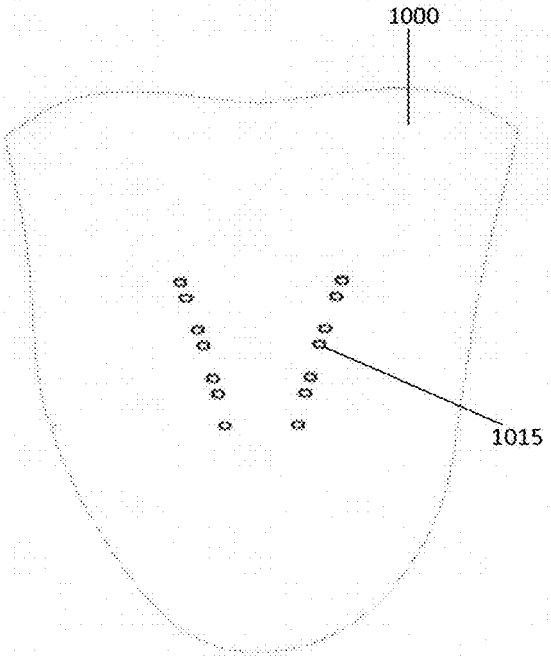
Figure 23E:
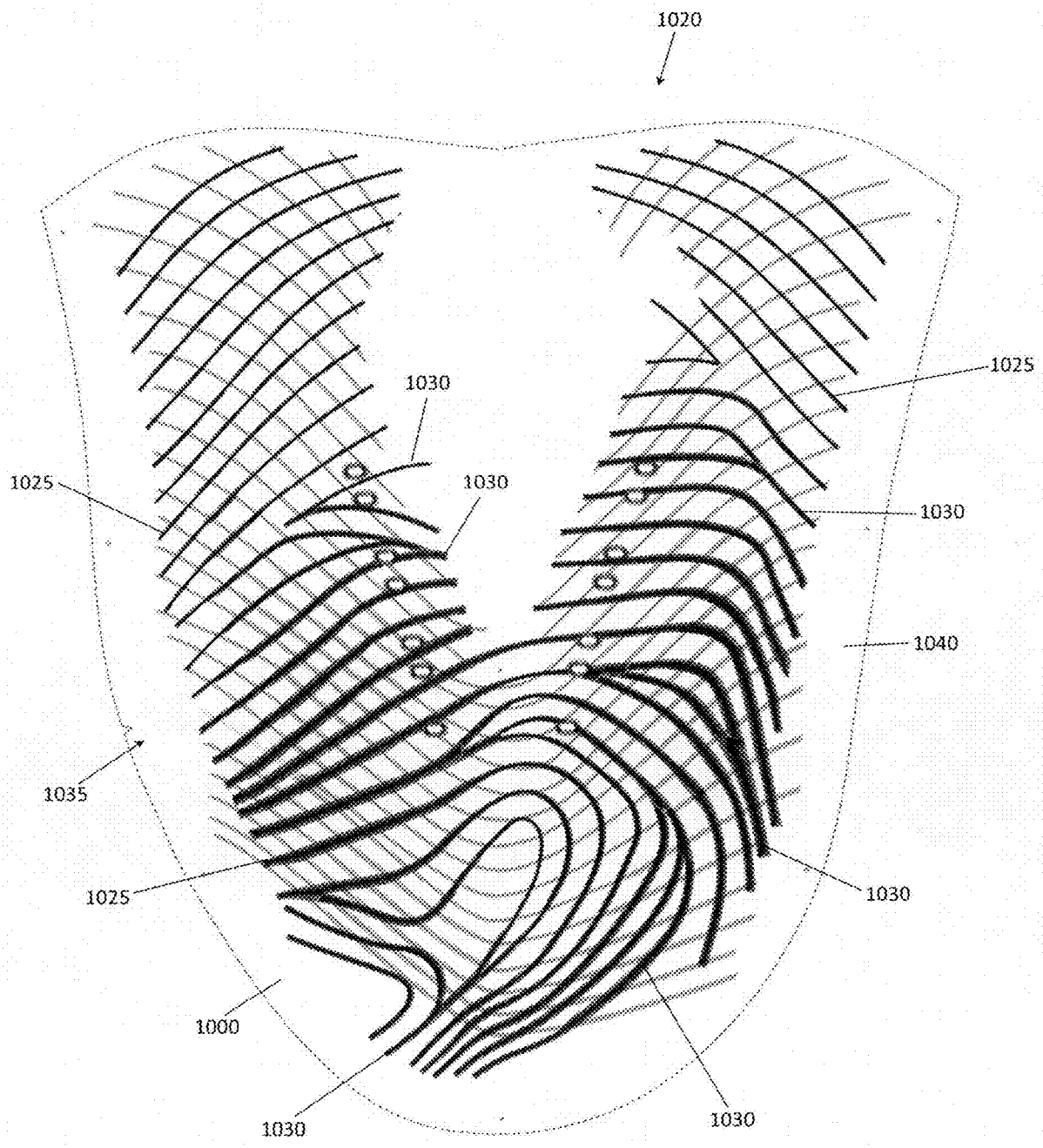
FIG. 23E is a top view of an assembled multi-layered embroidered footwear upper shell incorporating the layers of FIGS. 23A to 23D.
Figure 24:
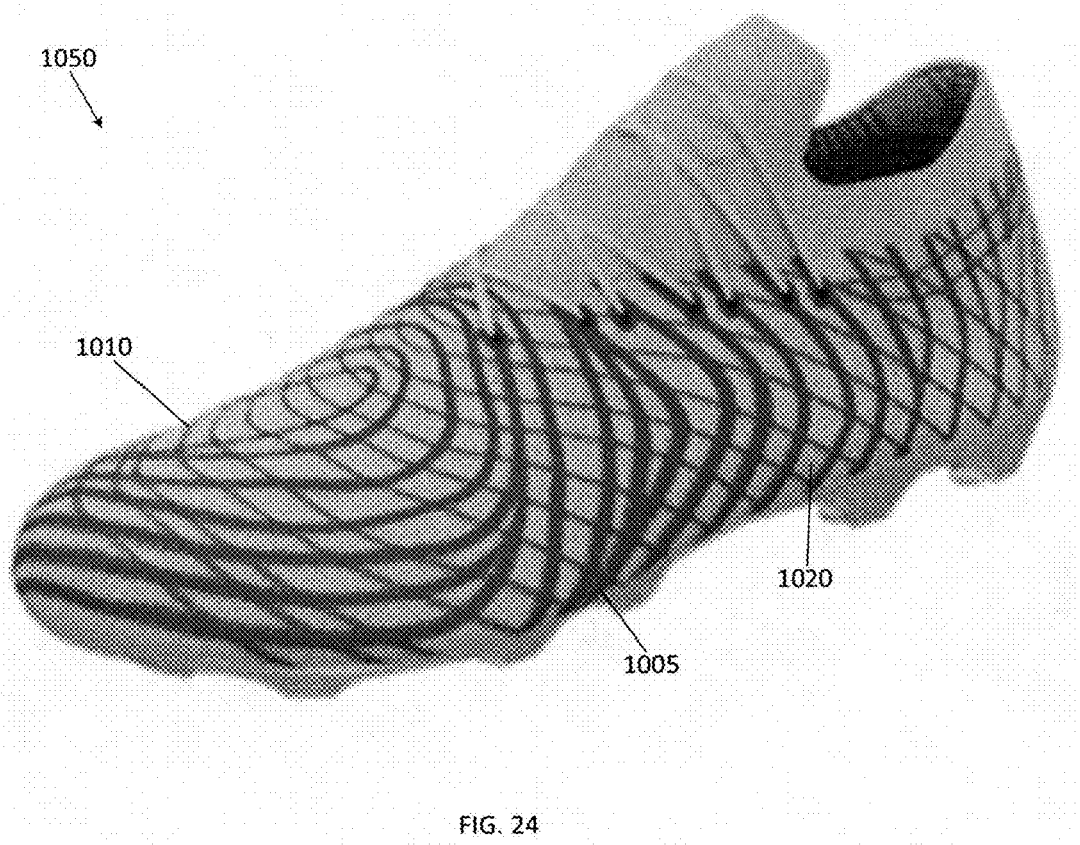
FIG. 24 is a perspective view of an article of footwear incorporating the multi-layered embroidered footwear upper shell of FIG. 23E.

An exemplary upper construction for a soccer cleat incorporating a plurality of embroidery patterns associated with different athletic motions (cutting and breaking) are shown in FIGS. 23A through 23E. The upper construction includes a base layer shell 1000 onto which a first embroidery pattern 1005 is stitched. A second embroidery pattern 1010 having a different configuration is also added to the base layer shell 1000, and a third embroidery pattern comprising a plurality of lace eyelet support holes 1015 can also be added. The resulting upper shell 1020 having a medial side 1035 and a lateral side 1040 is shown in FIG. 23E. Each of the first embroidery pattern 1005 and the second embroidery pattern 1010 includes discrete single elongate embroidered elements 1025 and branching elongate embroidered elements 1030. A shoe 1050 incorporating the upper shell 1020 is shown in FIG. 24.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. An article of footwear having an upper and a sole structure secured to the upper, the upper comprising a first upper element comprising:

a base layer having an interior surface and an opposite exterior surface, the interior surface facing an interior of the article of footwear; and a first structural layer comprising at least one first fiber embroidered onto the exterior surface of the base layer, the at least one first fiber forming a plurality of first discrete, separate elongate structural elements extending over the exterior surface of the base layer to provide discrete localized structural support to the base layer, wherein adjacent elongate structural elements define a gap therebetween and wherein the first elongate structural elements each comprise: (i) a plurality of zig-zag stitches extending across a longitudinal direction of the elongate structural element, wherein a span of each zig-zag stitch defines a transverse width of the elongate structural element; (ii) a zig-zag stitch density; and (iii) a stitch angle for each zig-zag stitch with respect to the longitudinal direction of the elongate structural element, and wherein the longitudinal direction of the elongate structural element and the transverse width of the elongate structural element vary over at least one section of a length of each of at least a first group of the first elongate structural elements, and the longitudinal direction of at least two adjacent elongate structural elements extends in a parallel direction for a first portion of their lengths and in a non-parallel direction for a second portion of their lengths, and wherein at least one of the first elongate structural elements comprises a first distal end and a second distal end each extending to a lower edge of the upper.

2. The article of footwear of claim 1, wherein at least one of the zig-zag stitch density and zig-zag stitch angle varies over the length of at least one of the first group of the first elongate structural elements.

3. The article of footwear of claim 1, wherein the longitudinal direction and the transverse width vary smoothly over the at least one section of the length of the at least one first group of the first elongate structural elements.

4. The article of footwear of claim 1, wherein the first structural layer reduces a stretch of a portion of the base layer in a direction substantially aligned with the longitudinal direction of the first elongate structural elements extending over that portion of the base layer.

5. The article of footwear of claim 4, wherein an amount of reduction in the stretch of the portion of the base layer is positively related to the transverse width of the first elongate structural element extending over that portion of the base layer.

6. The article of footwear of claim 1, wherein at least a portion of the at least one first fiber embroidered onto the exterior surface of the base layer is at least partially fused to the exterior surface of the base layer through the application of at least one of heat and pressure.

7. The article of footwear of claim 1, wherein each first elongate structural element comprises a different first fiber portion.

8. The article of footwear of claim 1, wherein the first fiber comprises at least one of a thread, a filament, a cord, a lace, a strand, a ribbon, or a band.

9. The article of footwear of claim 1, wherein the first fiber comprises a material selected from the group consisting of thermoplastic polyurethane, polyester, nylon, and a natural fiber.

10. The article of footwear of claim 1, wherein the stitch density is between 10 and 30 stitches per centimeter.

11. The article of footwear of claim 10, wherein the stitch density is between 15 and 25 stitches per centimeter.

12. The article of footwear of claim 1, wherein the stitch angle is between 30 and 60 degrees from the longitudinal direction.

13. The article of footwear of claim 1, further comprising a second structural layer comprising at least one second fiber embroidered onto the exterior surface of the base layer, the at least one second fiber forming a plurality of second elongate structural elements extending over the exterior surface of the base layer to provide localized structural support to the base layer, wherein the second elongate structural elements each comprise: (i) a plurality of zig-zag stitches extending across a longitudinal direction of the elongate structural element, wherein a span of each zig-zag stitch defines a transverse width of the elongate structural element; (ii) a zig-zag stitch density; and (iii) a zig-zag stitch angle for each zig-zag stitch with respect to the longitudinal direction of the elongate structural element, and wherein the longitudinal direction of the elongate structural element and the transverse width of the elongate structural element vary over at least one section of a length of each of at least a first group of the second elongate structural elements, and wherein an arrangement of the second elongate structural elements differs from an arrangement of the first elongate structural elements.

14. The article of footwear of claim 13, wherein at least one of the zig-zag stitch density and the zig-zag stitch angle varies over the length of at least one of the first group of the second elongate structural elements.

15. The article of footwear of claim 13, wherein the longitudinal direction and the transverse width vary smoothly over at least one section of the length of the first group of the second elongate structural elements.

16. The article of footwear of claim 13, wherein the longitudinal direction of a plurality of second elongate structural elements differs from that of their adjacent second elongate structural elements.

17. The article of footwear of claim 13, wherein the second structural layer reduces a stretch of a portion of the base layer in a direction substantially aligned with the longitudinal direction of the second elongate structural elements extending over that portion of the base layer.

18. The article of footwear of claim 17, wherein an amount of reduction in the stretch of the portion of the base layer is positively related to the transverse width of the second elongate structural element extending over that portion of base layer.

19. The article of footwear of claim 13, wherein at least a portion of the at least one second fiber embroidered onto the exterior surface of the base layer is at least partially fused to the exterior surface of the base layer through the application of at least one of heat and pressure.

20. The article of footwear of claim 13, wherein each second elongate structural element comprises a different second fiber portion.

21. The article of footwear of claim 13, wherein the second fiber comprises at least one of a thread, a filament, a cord, a lace, a strand, a ribbon, or a band.

22. The article of footwear of claim 13, wherein the second fiber comprises the same material as the first fiber.

23. The article of footwear of claim 13, where at least one of a color, a material, or a diameter of the first fiber differs from that of the second fiber.

24. The article of footwear of claim 13, wherein the second structural layer comprises a first region extending over the exterior surface of the base layer and at least a portion of the first structural layer.

25. The article of footwear of claim 24, wherein the second structural layer further comprises a second region extending over a portion of the exterior surface of the base layer on which the first structural layer is absent.

26. The article of footwear of claim 24, wherein the first structural layer further comprises a region extending over a portion of the exterior surface of the base layer on which the second structural layer is absent.

27. The article of footwear of claim 1, further comprising a third structural layer comprising at least one third fiber embroidered onto the exterior surface of the base layer over the first structural layer, the at least one third fiber forming at least one of a boundary of at least one lace hole or an identifying indicia.

28. The article of footwear of claim 1, wherein at least another one of the first elongate structural elements comprises a first distal end and a second distal end, wherein the first distal end extends to the lower edge of the upper and the second distal end extends to an opening for a foot of a wearer.

29. An article of footwear having an upper and a sole structure secured to the upper, the upper comprising a first upper element comprising:

a base layer having an interior surface and an opposite exterior surface, the interior surface facing an interior of the article of footwear;

a first structural layer comprising a plurality of first discrete, separate embroidered elongate elements extending over at least a portion of the exterior surface of the base layer, wherein adjacent elongate structural elements define a gap therebetween and wherein the first embroidered elongate elements each comprise a plurality of zig-zag stitches extending across a first longitudinal direction, wherein a span of each zig-zag stitch defines a transverse width of the elongate structural element, a zig-zag stitch density, and a stitch angle for each zig-zag stitch with respect to the first longitudinal direction, and wherein (i) the first longitudinal direction and the transverse width of at least one of the first embroidered elongate elements varies smoothly over a length of at least a first section of the first embroidered elongate element, (ii) at least a portion of at least one first embroidered elongate element is at least partially fused to the exterior surface of the base layer through the application of at least one of heat and pressure, and (iii) at least one of the first embroidered elongate structural elements comprises a first distal end and a second distal end each extending to a lower edge of the upper, and (iv) the first longitudinal direction of at least two adjacent elongate structural elements extends in a parallel direction for a first portion of their lengths and in a non-parallel direction for a second portion of their lengths; and a second structural layer comprising a plurality of second embroidered elongate elements extending over at least a portion of the exterior surface of the base layer, wherein the second embroidered elongate elements each comprise a plurality of zig-zag stitches extending across a second longitudinal direction, wherein a span of each zig-zag stitch defines a transverse width of the elongate structural element, a zig-zag stitch density, and a stitch angle for each zig-zag stitch with respect to the second longitudinal direction, and wherein: (i) at least one of the second longitudinal direction and the transverse width of at least one of the second embroidered elongate elements varies smoothly over a length of at least a first section of the second embroidered elongate element, (ii) at least a portion of at least one second embroidered elongate element is at least partially fused to the exterior surface of the base layer through the application of at least one of heat and pressure, and (iii) an arrangement of the second embroidered elongate elements differs from an arrangement of the first embroidered elongate elements.

30. The article of footwear of claim 29, wherein at least another one of the first elongate structural elements comprises a first distal end and a second distal end, wherein the first distal end extends to the lower edge of the upper and the second distal end extends to an opening for a foot of a wearer.

* * * * *